US010196773B2

(12) United States Patent
Bison et al.

(10) Patent No.: US 10,196,773 B2
(45) Date of Patent: Feb. 5, 2019

(54) LAUNDRY DRYER

(71) Applicant: Electrolux Appliances Aktiebolag, Stockholm (SE)

(72) Inventors: Alberto Bison, Pordenone (IT); Nicola Reid, Budoia (IT); Giuseppe Rossi, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 408 days.

(21) Appl. No.: 14/785,156

(22) PCT Filed: Apr. 17, 2013

(86) PCT No.: PCT/EP2013/058024
§ 371 (c)(1),
(2) Date: Oct. 16, 2015

(87) PCT Pub. No.: WO2014/169955
PCT Pub. Date: Oct. 23, 2014

(65) Prior Publication Data

US 2016/0083894 A1 Mar. 24, 2016

(51) Int. Cl.
*F26B 3/00* (2006.01)
*D06F 58/22* (2006.01)
*D06F 58/24* (2006.01)

(52) U.S. Cl.
CPC ..... *D06F 58/22* (2013.01); *D06F 58/24* (2013.01)

(58) Field of Classification Search
CPC ..... D06F 58/22; D06F 58/24; D06F 58/26; D06F 58/206

(Continued)

(56) References Cited

U.S. PATENT DOCUMENTS 5,031,410 A * 7/1991 Plzak ..... F25B 43/043 62/475
2005/0138831 A1* 6/2005 Lee ..... D06F 58/24 34/73

(Continued)

FOREIGN PATENT DOCUMENTS

DE 10 2008 054832 A1 7/2010
DE 10 2009 047155 A1 6/2011

(Continued)

OTHER PUBLICATIONS

PCT/EP2013/058024, International Search Report, dated Jan. 29, 2014.

(Continued)

*Primary Examiner* — John McCormack
(74) *Attorney, Agent, or Firm* — RatnerPrestia

(57) ABSTRACT

A laundry dryer (2) has a casing (3), a laundry storing compartment (18) arranged within the casing (3) for receiving laundry (19) to be dried by passing process air through the laundry storing compartment, a heat exchanger (10) for dehumidifying the process air after passing the laundry storing compartment (18), and a removable condensate reservoir (28) for storing condensed water formed at the heat exchanger (10). The reservoir (28) has a reservoir outlet for draining condensate liquid stored therein and a closing element for closing the reservoir outlet when the condensate reservoir is extracted from a reservoir compartment (30). The reservoir compartment (30) is associated to the casing (3) for receiving and housing the removable condensate reservoir (28), wherein the removable condensate reservoir (28) can be extracted from and inserted into the reservoir compartment (30). A supply line (32) for cleaning a component of the dryer and including a supply line inlet fluidly connected to the reservoir outlet (29) when the removable condensate reservoir (28) is inserted in the reservoir compartment (30), a supply line outlet for delivering condensed water to the component to be cleaned, and a pump (44) for (Continued)

conveying condensed water from the supply line inlet to the supply line outlet. A coupling arrangement associated to the reservoir outlet (29) and/or the supply line inlet and adapted to actuate the closing element. The coupling arrangement is adapted to maintain the closing element in an open state when the condensate reservoir (28) is inserted into the reservoir compartment (30), such that condensate liquid can freely flow from the reservoir outlet to the supply line (32); and wherein the a portion of the supply line (32) is located above a maximum condensate liquid level of the condensate reservoir (28).

20 Claims, 20 Drawing Sheets

(58) Field of Classification Search
USPC ..... 34/449, 467, 468, 469, 73, 74
See application file for complete search history.

(56) References Cited

U.S. PATENT DOCUMENTS

2010/0146809 A1* 6/2010 Grunert ..... D06F 58/24 34/443
2010/0243002 A1* 9/2010 Grunert ..... D06F 58/24 134/34
2010/0313532 A1* 12/2010 Stjernfelt ..... A61M 16/0808 55/482
2011/0229345 A1* 9/2011 Konnur ..... E03B 5/00 417/53
2012/0246960 A1* 10/2012 Lee ..... D06F 58/206 34/86
2014/0013958 A1* 1/2014 Krasne ..... A47J 31/407 99/284

FOREIGN PATENT DOCUMENTS

EP 1975297 A1 10/2008
EP 1 990 466 A1 11/2008
EP 2 138 627 A1 12/2009

OTHER PUBLICATIONS

Australian Examination Report for Australian Application No. 2013387149, dated Feb. 20, 2018, 4 pages.

* cited by examiner

LAUNDRY DRYER

The invention relates to a laundry dryer comprising means for cleaning a component of the dryer.

BACKGROUND

DE 10 2008 054 832 A1 discloses a laundry dryer comprising a device for cleaning a heat exchanger or process air filter arranged in a process air circuit of the dryer. Condensate generated at the heat exchanger during a drying operation of the dryer is collected in a first container from where it is fed to a liquid filter device to filter fluff from the collected liquid. The filtered liquid is collected in a second condensate container. The second container comprises a solenoid valve which is opened to convey the collected condensate by means of gravity to the heat exchanger for cleaning the heat exchanger surface, i.e. to wash off fluff.

SUMMARY OF SELECTED INVENTIVE ASPECTS

It is an object of the invention to provide a dryer comprising an improved cleaning means.

Aspects of the invention relate to a laundry dryer, preferably a condensate type dryer, a cabinet dryer or a vented dryer, more preferably a heat-pump tumble dryer, is provided comprising a casing, wherein the casing may also be denoted as a housing which is essentially the outer apparatus body. A laundry storing compartment, for example a drum, is arranged within the casing for receiving laundry to be dried by passing process air through the laundry storing compartment. The dryer further comprises a heat exchanger for dehumidifying the process air after passing the laundry storing compartment and a removable condensate reservoir for storing condensed water formed at the heat exchanger.

The removable condensate reservoir comprises a reservoir outlet for draining condensate liquid stored therein and a closing element for closing the reservoir outlet when the condensate reservoir is extracted from a reservoir compartment. The reservoir compartment is associated to the casing for receiving and housing the removable condensate reservoir, wherein the removable condensate reservoir can be extracted from and inserted into the reservoir compartment. Preferably the condensate reservoir is formed as drawer. The closing element is always—i.e. permanently—open when the condensate reservoir is inserted in its operation position (fully inserted) in the reservoir compartment. In particular the closing element is not adapted to close when the condensate reservoir is inserted into the compartment.

A supply line for cleaning a component of the dryer is provided which includes a supply line inlet fluidly connected to the reservoir outlet when the removable condensate reservoir is inserted in the reservoir compartment. Preferably the inlet of the supply line comprises a stationary inlet, wherein the stationary inlet is an opening stationary (fixedly) arranged within the body of the dryer which (in normal operation) is adapted to receive all liquid flowing out of the reservoir outlet. The supply line comprises a supply line outlet for delivering condensed water to the component to be cleaned. The component to be cleaned is for example and/or a or the heat exchanger or a filter element of the dryer. Preferably the filter element is an air filter for filtering fluff from the process air and/or the filter element is arranged upstream the heat exchanger in a process air channel. A pump is adapted to convey condensed water from the supply line inlet to the supply line outlet.

A coupling arrangement is associated to the reservoir outlet and/or the supply line inlet and is adapted to actuate the closing element. The coupling arrangement is adapted to maintain the closing element in an open state when the condensate reservoir is inserted into the reservoir compartment, such that condensate liquid can freely flow from the reservoir outlet to the supply line. For example the closing element may be a self-closing valve and/or the coupling arrangement may comprise a self-closing valve.

A portion of the supply line is located above a maximum condensate liquid level of the condensate reservoir, e.g. a siphon-structure is used such that an unintentional draining of the condensate reservoir by means of gravity is prevented. In particular a rising portion, a communication portion and a descending portion of the supply line forms a siphon. The supply line and the reservoir form communicating 'pipes', wherein the liquid in the supply line can only rise as high as the maximum reservoir liquid level. Consequently by means of the hydrostatic pressure of the condensate reservoir alone, liquid cannot pass the portion of the supply line which is higher than the maximum reservoir liquid level (e.g. the communicating portion). Thus additional pressure has to be applied for starting a rinsing or flushing operation.

Preferably the siphon effect is started with the start of the pump and is ended when the pump is stopped and when air enters inside the pump body and passes into the siphon. The siphon or the rising/descending/highest point etc. relates to positional relations when the dryer is oriented in a state for user operation. At the highest point of the flow path in the siphon, the lowest liquid flow path level is higher than the maximum level in liquid reservoir, such that at all times the desired siphon effect can be maintained. In particular a maximum liquid level in the liquid reservoir is a level where no further liquid can be stored (in normal operation) or where an overflow is provided in the reservoir such that additional liquid supplied to reservoir instantaneously escapes the reservoir. For example, during a rinsing operation liquid passes through the supply line, wherein a nozzle or an outlet which supplies the liquid to the apparatus component to be rinsed may be arranged at an end or extension of the descending portion or at the pump outlet or at a line connected to the pump outlet.

In contrast to DE 10 2008 054 832 A1, the above described laundry dryer supplies liquid or condensate to a component to be cleaned by means of a pump. I.e. the flow of the supplied liquid, e.g. the volume flow rate or water pressure, can be easily adjusted. In particular throughout a flushing or rinsing operation a stable flow of liquid is maintained due to the pump operation. For example the content of the condensate reservoir may be discharged at a flow rate which is higher than a flow rate generated using gravity only. I.e. due to the higher flow rate the components is cleaned efficiently. Thus aspects of the laundry dryer provides an improved cleaning means for cleaning a component of the dryer.

Preferably the reservoir compartment comprises or forms the supply line inlet, in particular the supply line inlet, is arranged at the reservoir compartment. For example the supply line inlet is arranged at a housing wall of the reservoir compartment, wherein the supply line inlet and a housing wall of the reservoir compartment may form a single piece construction. The supply line inlet may be a wall opening or may be a stub or pipe socket, e.g. extending from a wall and/or extending into the reservoir outlet when the reservoir is in its inserted position. The reservoir outlet may be a reservoir wall opening or may be a stub e.g. extending from the reservoir wall into the supply line inlet or stationary inlet of the supply line when the reservoir is in its inserted position. Preferably the supply line comprises an inlet or stationary inlet at a rear wall of the reservoir compartment and/or the reservoir outlet is arranged at a rear wall of the condensate reservoir. When a drawer-like reservoir is provided having an outlet at a rear portion thereof, the reservoir outlet may be inserted or coupled to a supply line inlet by the inserting movement of the reservoir into the reservoir compartment. Thereby a convenient and easy to handle coupling of the reservoir (outlet) to the supply line (inlet) is provided. More preferably a sealing element or a sealing arrangement is arranged between the reservoir outlet and the stationary supply line inlet to provide a leak-proof connection.

According to a preferred embodiment the reservoir compartment comprises a drain to convey condensed water back to a sump adapted to collect the condensed water formed at the heat exchanger. Additionally or alternatively the reservoir compartment is not adapted to permanently or temporarily store liquid drained or spilled from the condensate reservoir. For example when liquid is spilled into the reservoir compartment, the spilled liquid is immediately drained to the sump, e.g. via a (permanently open) opening connecting the reservoir compartment to the sump. Thereby a risk of liquid overflowing the reservoir compartment is prevented in a convenient and easy way.

Preferably the coupling arrangement is associated to the reservoir compartment. E.g. the coupling arrangement is formed at the reservoir compartment, e.g. the coupling arrangement and the reservoir compartment are formed in one piece or are attached to each other. Preferably the coupling arrangement remains in the dryer when the condensate reservoir is removed, e.g. for emptying, such that the coupling arrangement is protected and additionally the weight of the (extracted) reservoir is reduced, whereby the extractable reservoir is easy to handle for a user.

Preferably the liquid pump is arranged upstream or downstream relative to the communication portion. For example, if the pump has liquid/air sucking capability, it can also be placed downstream from the communication portion, i.e. downstream from the siphon. In this embodiment, initially the pump is located in the part of the supply line (descending portion) which contains air, i.e. no liquid. Thus at the beginning of a rinsing operation the pump would suck air from the supply line until liquid from the reservoir reaches the pump, which is then pumped towards the component to be cleaned. In the alternative, when the pump is arranged upstream the communication portion, the pump is located in the part of the supply line (rising portion) which contains liquid. When the pump starts operating it immediately sucks liquid from the reservoir, e.g. until the reservoir is empty. Then the pump also sucks air from the empty container, which effectively terminates the siphon effect as soon as the communication portion is filled with air, i.e. contains no liquid, as described above. Then the rinsing operation is finished or terminated and the pumping system is again in the initial state, where the reservoir may be filled again with condensate while the siphon-effect prevents that the reservoir is unintentionally drained.

Preferably the pump is arranged at an upper section of the apparatus. Additionally or alternatively the reservoir compartment comprises a supporting structure for the pump of the supply line. For example the pump may be arranged inside or outside the reservoir compartment, wherein a supporting structure may be arranged inside or outside the reservoir compartment. This results in advantageous short connection lines as the lines do not have to be guided a far distance downward to the pump and then upward to the siphon. Alternatively the pump may be positioned behind the condensate reservoir, at a lateral side of the reservoir or below the reservoir. For example in a space below the reservoir in a niche between the casing and the laundry compartment.

The pump or the siphon of the supply line may be arranged at the backside of a rear wall or rear frame of the apparatus. Additionally or alternatively the pump may be arranged outside the casing. In particular the supply line may extend at least partly at the backside of a rear wall of the casing. With respect to the normal operation orientation of the dryer the backside or rear wall of the dryer is arranged opposite to a front side of the dryer where a loading opening and/or input panel may be formed. Generally in the casing of a household appliance only little free space is available. By arranging one or more components outside the casing or at a backside of a rear wall/frame, more space is available for the components for cleaning, e.g. for the supply line and flushing pump.

Preferred the communication portion of the supply line is arranged close to or is guided over the pump and/or over and adjacent to the condensate reservoir, hence a space-saving arrangement of the supply line is provided.

Preferably the pump is arranged in a lower section of the apparatus or at or on a cover shell in a base section of the apparatus. Usually more space is available in a bottom section of a dryer, in particular below a drum. For example the pump may be positioned below a center plane running through the laundry compartment and/or may be positioned on or at a battery unit or may be attached to a battery unit arranged in the case of the dryer. For example a battery unit provides a portion of a process air channel and houses amongst others the heat exchanger of the dryer. This pump arrangement is advantageous when liquid is leaking from the pump, e.g. due to a malfunction of the pump. I.e. as most electronic components are arranged in upper section of apparatus, these components are safe from damage by leakage water.

According to a preferred embodiment the condensate reservoir comprises a first compartment for storing liquid and a second compartment for storing liquid, wherein the reservoir outlet is arranged at the first compartment. The term 'arranged at' comprises for example forming a wall opening in a wall of the first compartment. Preferably both compartments are arranged within the condensate reservoir and are thus extractable together from reservoir compartment. A preferred ratio of storing volumes of the second to the first compartment is less than 1, preferably less than 0.8, 0.6, 0.4 or 0.2. I.e. the storing volume of the first compartment is larger than storing volume of the second compartment, such that most of the liquid stored in the reservoir may be used for a rinsing operation. For example the first compartment has a storing volume of 3.5 liters and the second compartment a storing volume of 2 liters. In this example the dryer component like for example the heat exchanger may be flushed in one rinse operation (at most) with 3.5 liters of liquid.

Preferably the first and second compartments are separated by a separation wall having a liquid passage arranged below the maximum liquid level of the first and/or second compartment. For example the separation wall comprises one or more through holes or slits or any other opening(s). Alternatively the first and second compartments are connected by a liquid passage arranged below the maximum liquid level of the first and/or second compartment. In particular the passage is not an overflow-only passage, i.e. liquid passes the passage not only in case a maximum water level of the first/second compartment is exceeded. The passage allows liquid to flow even if one or both compartments are not completely full: via the passage the liquid levels of the first/second compartments may be leveled out. For example if the first compartment is emptied by a first flushing, liquid from the second compartment (slowly) flows to the first compartment and is therefore available for a second flushing. Preferably the opening of the passage at the second compartment is at a lower liquid level in relation to the maximum liquid storage level, more preferably the opening of the passage is at or close to the minimum level in the second compartment. For example a liquid passage in form of a channel may be arranged below the first and/or second compartment. Thus it is provided that a maximum amount of liquid may be transferred via the passage from the second compartment to the first compartment for an effective flushing.

The ratio of maximum flow rates through the supply line to the maximum flow rate through the liquid passage may be at least 2, 4, 6, 10 or 20, and additionally or alternatively the cross section area of the liquid passage may be less than 2, 1.5, 1, 0.5, 0.25 or 0.1 $cm^2$. I.e. the liquid passage is sufficiently small to allow only a low liquid flow rate (from the second to the first compartment and vice versa), which prevents that second compartment is rapidly or completely emptied during a flushing operation.

Preferably a fluff filter is arranged at the liquid passage for filtering fluff from liquid passing the liquid passage between the compartments. This is particularly useful for retaining fluff in the second compartment when condensate is first supplied to the second compartment and then flows filtered into the first compartment.

Preferably the supply line fluidly connects the stationary inlet of the supply line to the pump inlet. A fluid connection is provided when the pump is not positioned directly at the stationary inlet. In particular, when the pump is positioned directly at the reservoir outlet, the connection section between the reservoir outlet and the pump inlet is the 'supply line' for the purposes of understanding aspects of the invention. It is understood that the fluid connection between the reservoir outlet and the pump inlet does not have to be physically defined as a separate element. For example the reservoir outlet and/or the coupling arrangement may form the pump inlet or may form part of the pump inlet. Additionally or alternatively a pump wheel or pump vanes may partially penetrate into the coupling arrangement and/or the reservoir outlet.

The pump allows air to pass through the pump body from the emptied or nearly emptied liquid container into the supply line, such that air accumulates in the communication portion of the supply line and interrupts the liquid flow by eliminating the siphon-effect as described above.

The supply line may have an air inlet in the rising portion, descending portion or communication portion. In other words an air inlet may be formed at the siphon. The air inlet may be formed like a Venturi nozzle for sucking in air when liquid is passing and/or the air inlet is with respect to the surrounding air at a highest point of the siphon, such that no water leaks out. Thus, when a pumping activity is interrupted, air enters into siphon and efficiently eliminates the siphon-effect.

To provide clean liquid for each rinsing or flushing of the dryer component at least one filter element may be provided. Preferably a filter element is arranged at a condensate inlet of the condensate reservoir to filter fluff when liquid is supplied into the condensate reservoir. For example when a filter element is arranged at the condensate inlet the fluff collects at an outer surface of the filter element, such that the fluff can be easily removed, e.g. washed off below running water. In particular in this case it may not be necessary to remove the filter element from the reservoir for cleaning. Additionally or alternatively a filter element is arranged at the reservoir outlet for filtering fluff from the liquid exiting the condensate reservoir through an outlet of the condensate reservoir at the time when the condensate reservoir is inserted in the reservoir compartment and when a component flushing cycle is performed. For example the filter element is attached to the condensate reservoir such that it is removable from the reservoir compartment together with the condensate reservoir. Subsequently the filter element may be detached from the condensate reservoir to be cleaned by a user.

According to an embodiment the coupling arrangement comprises the filter element which is removably positioned in the liquid flow path, such when the condensate reservoir is inserted in the reservoir compartment the coupling arrangement opens the closing element and positions the filter element in the opened flow path. Alternatively the condensate reservoir comprises a removable filter element and the coupling arrangement comprises a stopping element which prevents opening of the closing element when the condensate reservoir is inserted in the reservoir compartment and the filter element is not positioned at its resting position at the condensate reservoir. I.e. it is effectively prevented that unfiltered liquid enters the supply line.

Preferably one or more filter elements for filtering the rinsing or condensate liquid are provided according to one or more of the following, i.e. one (or more) filter element(s): is arranged at an inlet of the condensate reservoir, is arranged at an outlet of the condensate reservoir, is arranged within the interior of the condensate reservoir, is positioned in the supply line, is arranged at or associated to the pump, is arranged in a rinsing or condensate liquid path at a base unit of the apparatus, is arranged at or associated to a drain pump, wherein the drain pump is adapted to pump rinsing or condensate liquid to the condensate reservoir, is positioned in a drain line fluidly connecting the outlet of the or a drain pump to the condensate reservoir, is positioned between the siphon and an outlet or nozzle for draining or spraying the rinsing liquid to the component to be rinsed, and is integrated with, arranged at or associated to the component to be rinsed. In particular the one or more filter elements are arranged such that each filter element is conveniently accessible for a user, e.g. for cleaning. E.g. the filter element(s) are accessible by extracting the condensate reservoir as described above or by arranging the filter element(s) at or close to a front of the dryer, in particular at an upper portion of the dryer, where the filter element(s) may be easily accessible via a lid arranged at the dryer casing.

BRIEF DESCRIPTION OF THE DRAWINGS

Reference is made in detail to preferred embodiments of the invention, examples of which are illustrated in the accompanying figures, which show.

DETAILED DESCRIPTION OF EXAMPLE EMBODIMENTS

Figure 1:
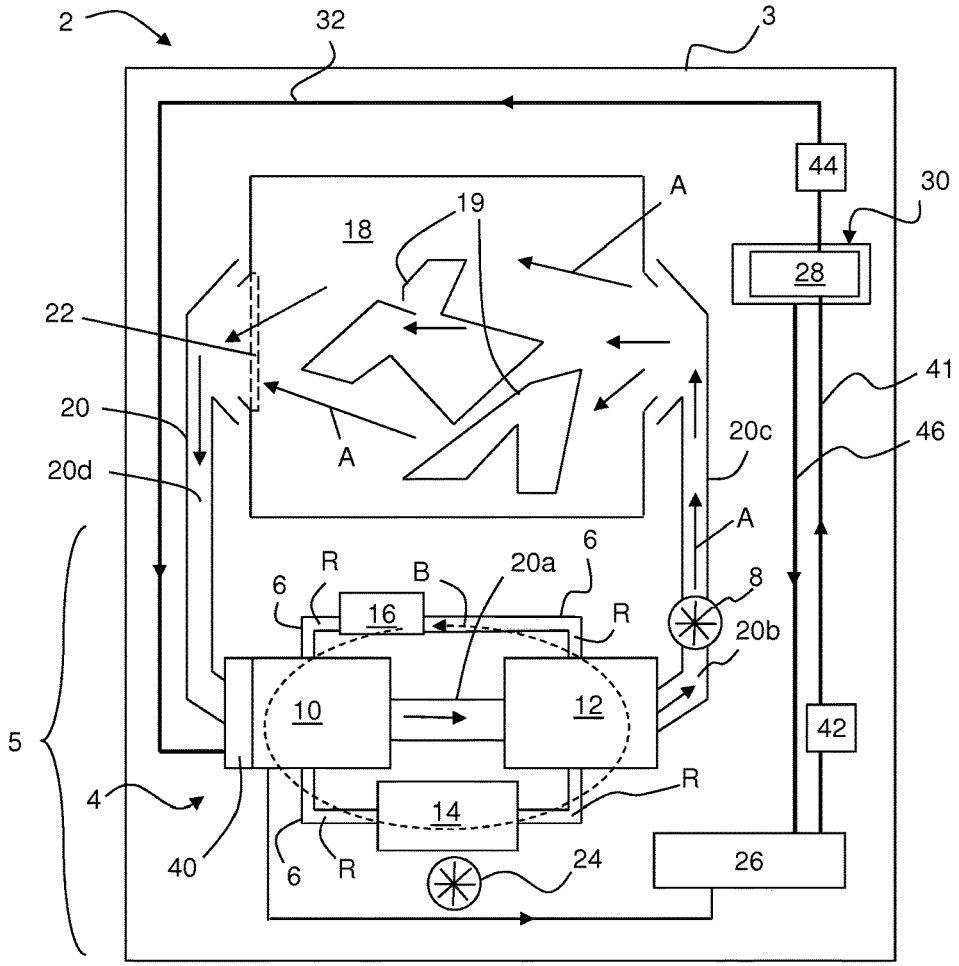
FIG. 1 a schematic view of a laundry dryer having a heat pump system.

FIG. 1 depicts in a schematic representation a laundry dryer 2 which in this embodiment is a heat pump tumble dryer. The tumble dryer 2 comprises a heat pump system 4, including in a closed refrigerant loop 6 in this order of refrigerant flow B: a first heat exchanger 10 acting as evaporator for evaporating the refrigerant R and cooling process air A, a compressor 14, a second heat exchanger 12 acting as condenser for cooling the refrigerant R and heating the process air, and an expansion device 16 from where the refrigerant R is returned to the first heat exchanger 10. Together with the refrigerant pipes connecting the components of the heat pump system 4 in series, the heat pump system 4 forms a refrigerant loop 6 through which the refrigerant R is circulated by the compressor 14 as indicated by arrow B. If the refrigerant R in the heat pump system 4 is operated in the transcritical or totally supercritical state, the first and second heat exchanger 10, 12 can act as gas heater and gas cooler, respectively.

The expansion device 16 is a controllable valve that operates under the control of a control unit 9 (FIG. 2) of the dryer to adapt the flow resistance for the refrigerant R in dependency of operating states of the heat pump system 4. Alternatively the expansion device may be a fixed cross-section valve or capillary tube.

The process air flow A within the treatment apparatus 2 is guided through a compartment 18 of the treatment apparatus 2, i.e. through a compartment 18 for receiving articles to be treated, e.g. a drum 18, which may be rotated by means of a drum motor 17. The articles to be treated are textiles, laundry 19, clothes, shoes or the like. In the embodiments described here these are preferably textiles, laundry or clothes. The process air flow is indicated by arrows A in FIG. 1 and is driven by a process air blower 8 or fan. The process air channel 20 guides the process air flow A outside the drum 18 and includes different sections, including the section forming the battery channel 20*a* in which the first and second heat exchangers 10, 12 are arranged. The process air exiting the second heat exchanger 12 flows into a rear channel 20*b* in which the process air blower 8 is arranged. The air conveyed by blower 8 is guided upward in a rising channel 20*c* to the backside of the drum 18. The air exiting the drum 18 through the drum outlet (which is the loading opening of the drum) is filtered by a fluff filter 22 arranged close to the drum outlet in or at the channel 20.

When the heat pump system 4 is operating, the first heat exchanger 10 transfers heat from process air A to the refrigerant R. By cooling the process air to lower temperatures, humidity from the process air condenses at the first heat exchanger 10, is collected there and drained to a condensate collector 26, which is preferably arranged below the heat exchangers 10, 12. The process air which is cooled and dehumidified after passing the first heat exchanger 10 passes subsequently through the second heat exchanger 12 where heat is transferred from the refrigerant R to the process air. The process air is sucked from exchanger 12 by the blower 8 and is driven into the drum 18 where it heats up the laundry 19 and receives the humidity therefrom. The process air exits the drum 18 and is guided in front channel 20*d* back to the first heat exchanger 10. The main components of the heat pump system 4 are arranged in a base section 5 or basement of the dryer 2.

A cooling air blower 24 or fan unit controlled by the control unit 9 of the dryer 2 may be arranged close to the compressor 14 to remove heat from the compressor 14, i.e. from the heat pump system 4, during a drying operation. The cooling air flow, which is an ambient air flow in the embodiments, is actively driven by the cooling air blower 24 and is taking heat from (the surface of) the compressor 14. By transferring heat from the compressor 14, during a normal operation mode of the heat pump system 4 (following to its warm-up phase), thermodynamic balance is achieved between the closed loops of the process air loop and refrigerant loop 6.

Figure 3:
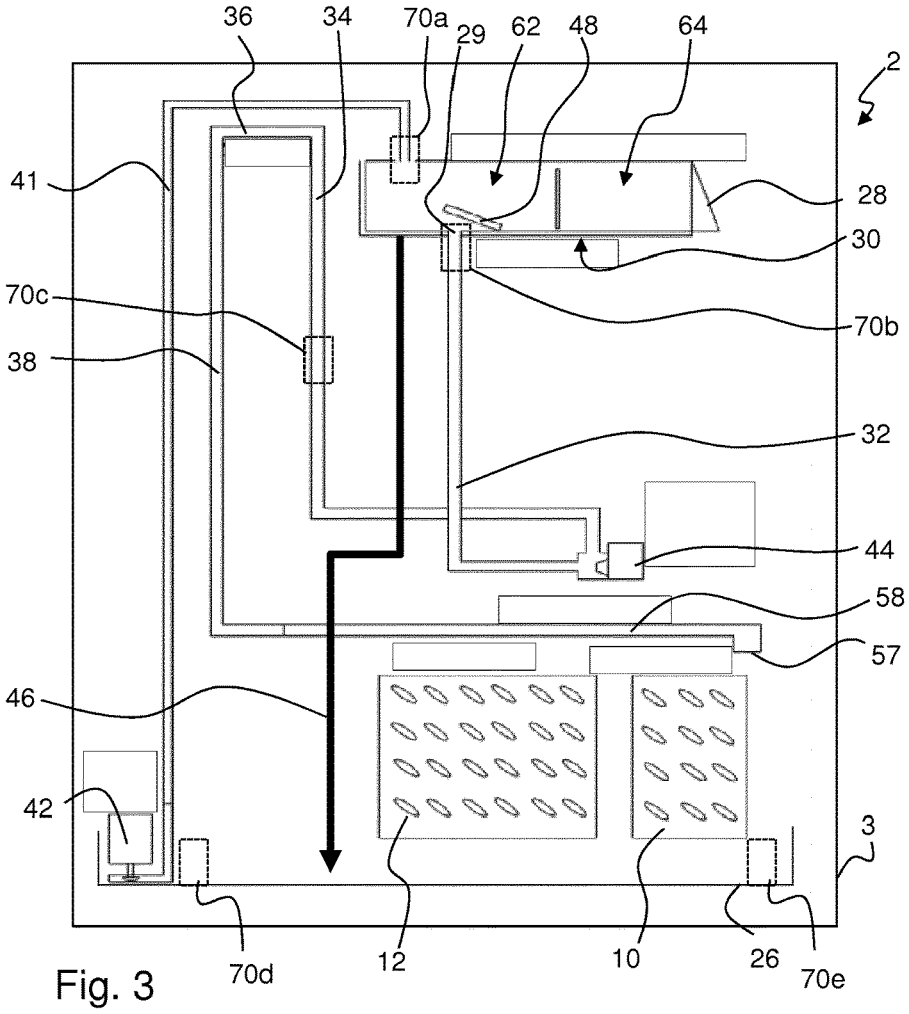
Figure 4:
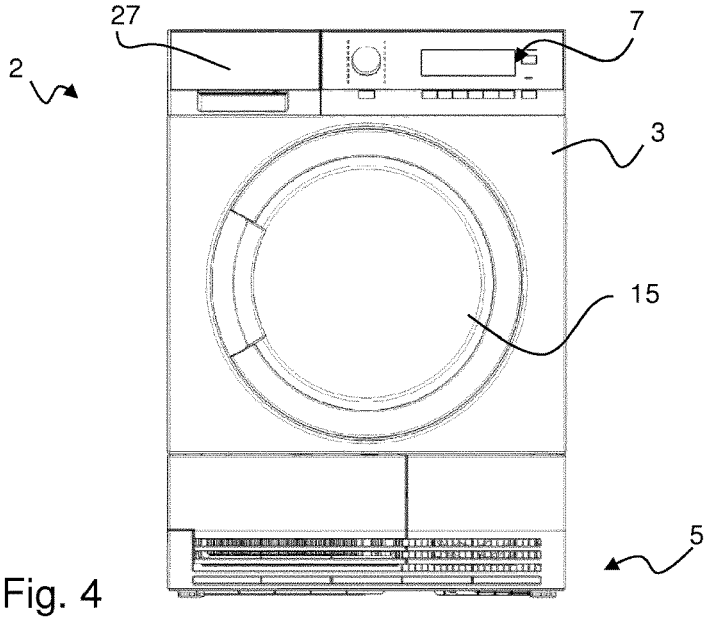

As schematically shown in FIG. 1 and in more detail in FIG. 3, during dryer operation condensate is collected in the condensate collector 26 or basement tank below the heat exchangers 10, 12. By means of a drain pump 42 and drain pipe 41 collected condensate is pumped to a condensate reservoir 28, which is arranged drawer-like in a reservoir compartment 30 at an upper portion of the dryer casing 3. A front 27 or front panel of the reservoir drawer 28 is shown in FIG. 4 having a handle for user inserting and pulling-out operation. The reservoir 28 comprises an outlet 29 which is fluidly connected to a supply line 32 or inlet of the supply line 32 when the reservoir 28 is inserted into the reservoir compartment 30. In particular the reservoir comprises a closing element 48 or valve, which is adapted to be opened by an actuating element 54 of the reservoir compartment 30 when the reservoir 28 is inserted into the compartment 30. When the reservoir 28 is inserted in its operating position within the compartment 30, the reservoir outlet 29 is permanently open. Additionally or alternatively the actuating element or part thereof may be provided at the reservoir 28. In FIG. 3 the outlet 29 and closing element 48 are exemplary depicted at a bottom or base of the reservoir 28. Alternatively the outlet 29 may be arranged at a rear portion of the reservoir 28.

As schematically shown in FIG. 3, a rinsing or flushing pump 44 which is controlled by the control unit 9 is adapted to pump condensate via the supply line 32 from the reservoir 28 to the first heat exchanger 10 or optionally to a filter element 40 (FIG. 1) upstream the first heat exchanger 10 to rinse or wash the respective component. By means of the supplied liquid collected fluff is washed off a (front) surface of the heat exchanger 10 or the filter element 40.

The rinsed off fluff and rinsing liquid is collected in the condensate collector 26 arranged below the heat exchangers 10, 12. Controlled by the control unit 9 a drain pump 42 pumps the collected liquid via a drain pipe 41 back to the reservoir 28. For example a liquid level sensor (not depicted) may be provided which is adapted to provide a signal to the control unit when a threshold value of a liquid level in the collector 26 is reached, then the control unit 9 may activate the drain pump 42.

To remove fluff from the liquid, one or more fluff filter(s) 70*a-e* or filter elements may be provided (FIG. 3). For example a fluff filter 70*a* may be arranged at an inlet of the reservoir 28, such that only filtered liquid enters the reservoir 28. Additionally or alternatively a fluff filter 70*b* may be arranged at the reservoir outlet 29, such that fluff is filtered from the liquid before the liquid passes the flushing pump 44. A fluff filter 70*c* may be arranged at any portion of the supply line 32, wherein it is advantageous to place the fluff filter 70*c* such that it is conveniently accessible from a front or top portion of the dryer casing 3 for cleaning. Further, a fluff filter 70*d* or 70*e* may be arranged upstream the drain pump 42, e.g. in the collector 26, such that liquid is filtered before it enters the drain pump 42, which improves the performance of the pump 42.

As schematically depicted in FIG. 3, the supply line 32 comprises a siphon formed by a rising portion 34, a communicating portion 36 and a descending portion 38. In the following an exemplary rinsing or cleaning operation is described.

When the dryer 2 starts operating condensate is generated at the first heat exchanger 10 as described above. The condensed liquid is collected in the condensate collector 26 and subsequently pumped by means of drain pump 42 and drain pipe 41 into the reservoir 28.

For example the drain pump 42 may be operated in dependency of a signal of a liquid level sensor arranged in the condensate collector 26 as described above. E.g. the drain pump 42 may be repeatedly switched on and off in dependency of the water level in the collector 26.

Figure 13A:
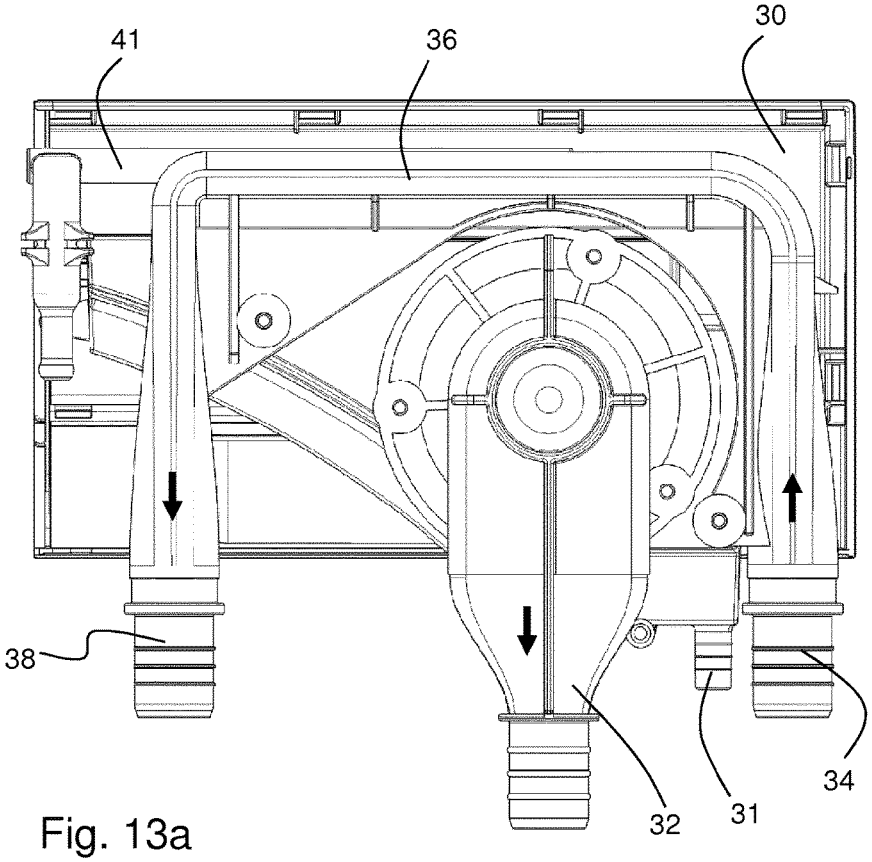
Figure 13B:
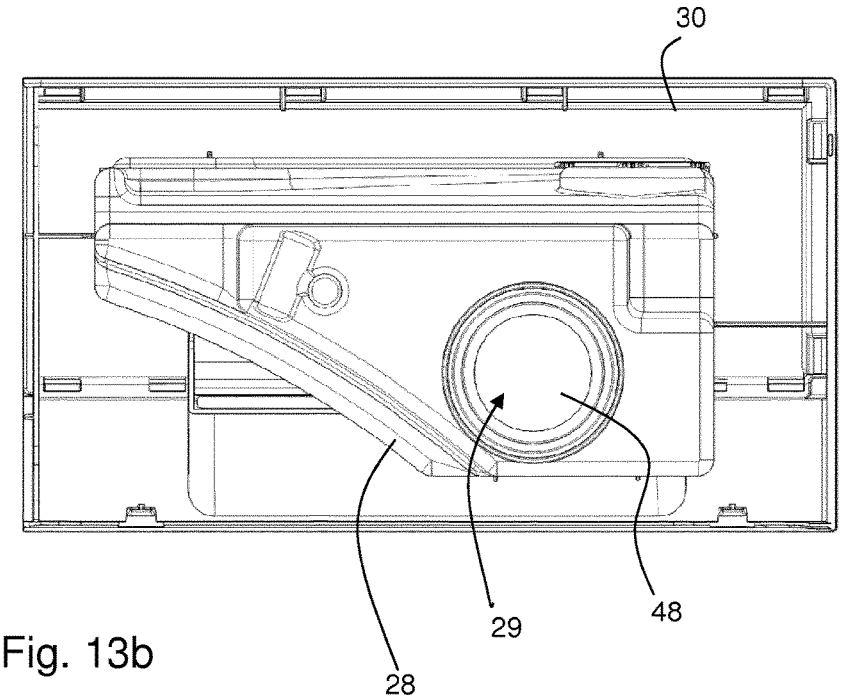
Figure 13C:
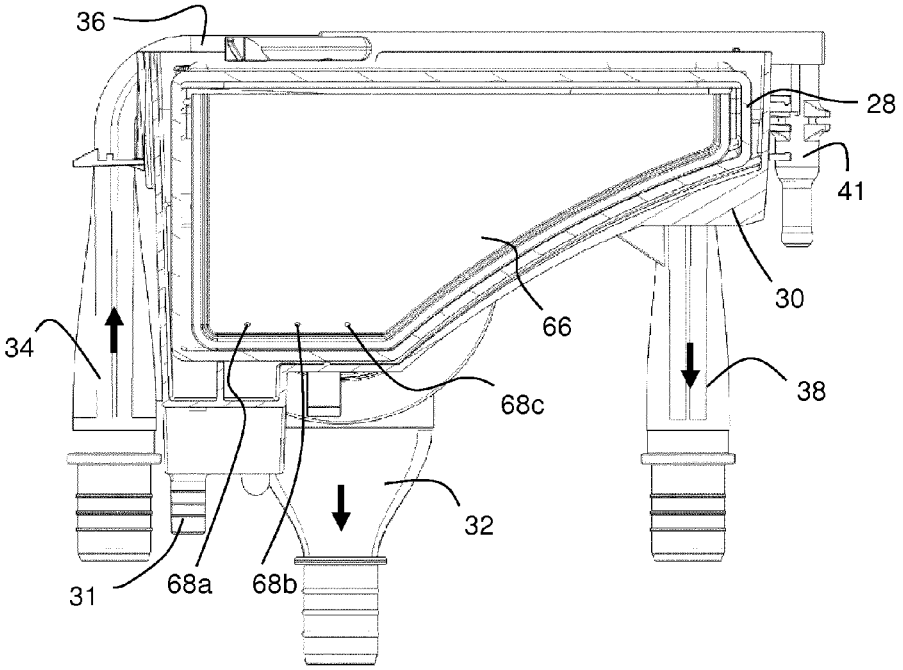

The reservoir 28 comprises a first compartment 62 (rinsing or flushing volume) and a second compartment 64 (retaining volume) which are divided by a separation wall 66 comprising small liquid passages 68*a-c* (FIG. 13*c*). The liquid from the collector 26 is supplied to the first compartment 62. The reservoir inlet or the outlet of the drain pipe 41 is arranged such that liquid is fed into the first compartment 62. When not operated the flushing pump 44 allows liquid to freely flow through the pump 44 in a forward or in a reverse conveying direction when the pump is switched-off. As the reservoir outlet 29 is permanently open, the supply line 32 is filled up until the liquid level in the supply line 32 (comprising the rising portion 34) corresponds to the liquid level in the first compartment 62. I.e. the supply line 32 and reservoir 28 form communicating 'pipes' in this way. As the supply line 32, in particular the communicating portion 36 thereof, is arranged higher than the maximum liquid level of the reservoir 28, the siphon structure of the supply line 32 prevents that the reservoir 28 is unintentionally emptied, i.e. it is prevented that a rinsing operation starts unintentionally when the pump is not operated.

When the liquid level in the first compartment 62 exceeds the height of the separation wall 66, liquid flows over the separation wall 66 and fills the second compartment 64. Additionally liquid flows via liquid passages 68*a-c* from the first compartment 62 to the second compartment 64 with a lower flow rate as compared to an overflow rate over the separation wall and/or the conveyance flow rate of pump 44.

In another embodiment (not shown), the separation wall 66, which is aligned vertically in the above embodiment, may be replaced by a separation wall that is oriented horizontally, is oriented inclined or is oriented partially vertical, inclined and/or horizontal. Note: All orientation relate to the operational positioning of the laundry dryer. Thus the first and second compartments may not necessarily be arranged side by side but can be arranged above each other or partially side by side and partially above each other. In any case the one or more liquid passages 68*a-c* are provided at a lower part of the separation wall such that a controlled low flow rate of liquid can flow from the second to the first compartment in case of liquid level difference. An overflow between the first and second compartment may also be provided. If the condensate flowing into the condensate reservoir is first supplied to the second compartment, it can flow to the first compartment through the liquid passage(s) (and possibly via the overflow therebetween). The above and below respectively applies to such another embodiment.

To start a rinsing operation, e.g. after a predetermined operation time of a drying program has elapsed or after the end of a drying cycle, the flushing pump 44 is activated via the control unit 9. The flushing pump 44 pumps liquid from the reservoir 28 via the supply line 32 to an outlet of the supply line, in particular to a flushing duct 58 which comprises a nozzle 57 arranged such that e.g. the heat exchanger 10 front surface is rinsed by the supplied liquid. The supply line 32 may be attached to the duct 58 and nozzle 57 such that the supply line 32 is fluidly connected to the duct 58 and nozzle. Alternatively the outlet of the supply line may be arranged such that supplied liquid is directly supplied to the component of the dryer 2 to be cleaned.

When the first compartment 62 is empty, i.e. all liquid stored therein has been supplied to the component to be cleaned, and the flushing pump 44 continues to operate, the pump 44 starts to pump air from the empty compartment 62 into the supply line 32 until the air reaches the communicating portion 36, whereby the siphon-effect is eliminated. Depending on pump operation conditions and when pump 44 is stopped, liquid draining in the descending portion 38 results in air entering through nozzle 57 or outlet which rises to the communicating portion 36 thereby also interrupting the siphon effect. The supply line 32 or the liquid supply system is again in its initial condition, where liquid can be supplied into the first compartment (from the condensate collector 26 or the second compartment 64) while the communicating portion 36 arranged above the highest reservoir liquid level prevents an unintentional emptying of the reservoir 28.

The rinsing liquid with the washed off fluff is collected in the condensate collector 26 after the rinsing operation. For removing the (dirty) liquid from the dryer 2, the collected liquid may be pumped via drain pump 42 back into the first compartment, basically as described above. The user may extract the reservoir 28 from the reservoir compartment 30 to empty the reservoir 28.

When a user extracts or pulls out the reservoir 28, the reservoir outlet 29 is closed by the closing element 48 or valve, such that the collected liquid is retained in the reservoir 28. Alternatively an additional drain outlet (not depicted) is fluidly connected via a valve to the drain pipe 41, whereby the collected dirty rinsing liquid may be directly drained from the dryer 2 by means of the drain pump 42.

The reservoir compartment 30 comprises an outlet 31 such that when liquid spills during removal of the reservoir 20 or when the reservoir 28 is overflowing, liquid enters the reservoir compartment 30 and is drained through outlet 31. The outlet 31 is connected via a drain pipe 46 to the condensate collector 26. The outlet 31 is permanently open and spilled liquid is immediately discharged to the condensate collector 26.

As described above, liquid from the second compartment 64 may flow to the first compartment 62 via the liquid passage 68*a-c*. The liquid passage 68*a-c* is arranged close to a base or bottom of the reservoir 28. When the liquid level of the second compartment 64 is low, it is provided that liquid flows with a low flow rate towards the (empty) first compartment 62 until the liquid levels in first and second compartment 62, 64 are leveled out. The cross-section of the liquid passage 68*a-c* is small, such that during emptying the first compartment 62 by means of the flushing pump 44 little or almost no liquid flows from the second compartment 64 to the first compartment 62. However, after a pause period following to a first pump/flushing operation, for example a second rinsing operation may be executed, wherein the liquid slowly flown from the second compartment 64 to the first compartment 62 may be used as rinsing liquid as described above.

Figure 2:
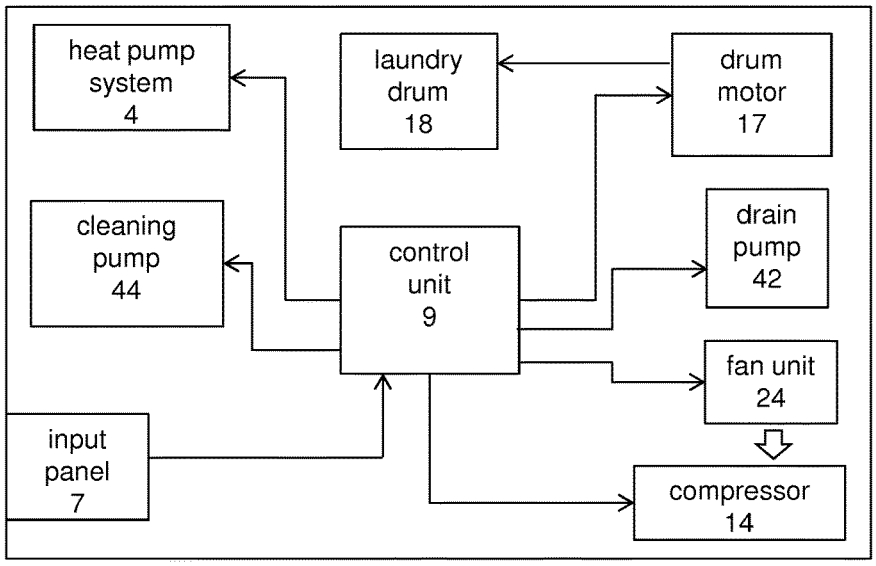
FIG. 2 a schematic block diagram of components of the laundry dryer of FIG. 1, FIG. 3 a schematic view of a cleaning system of the laundry dryer according to FIG. 1, FIG. 4 a front view of a laundry dryer, FIGS. 5*a-b* perspective rear views of the dryer of FIG. 3 with partially removed casing, FIGS. 6*a-c* a side view and sectional side views of the dryer of FIG. 3, FIG. 7 a top view of the dryer of FIG. 3, FIG. 8 a rear view of the dryer of FIG. 3, FIG. 9 a perspective top view of a reservoir compartment with inserted reservoir of the dryer of FIG. 3, FIGS. 10*a-b* sectional top views of a section of the condensate reservoir and reservoir compartment of FIG. 9, FIGS. 11*a-b* sectional side views of a section of the condensate reservoir and reservoir compartment of FIG. 9, FIGS. 12*a-b* a side view and a sectional side view of the reservoir and reservoir compartment of FIG. 9, FIG. 13*a* a rear view of the reservoir compartment of FIG. 9, FIG. 13*b* a rear view of the condensate reservoir, FIG. 13*c* a sectional front view of the reservoir compartment, FIG. 14*a-b* a sectional side view and detail of the reservoir and reservoir compartment of FIG. 9 showing a drain outlet of the compartment, FIGS. 15*a-c* a side view, a perspective view and a rear view of the dryer of FIG. 3 illustrating the arrangement of a drain pipe of the reservoir compartment, FIG. 16*a-b* a perspective rear view and detail of a dryer according to a further embodiment, and FIGS. 17*a-d* perspective views and sectional side views of an alternative coupling arrangement for a condensate reservoir.

In the following different embodiments of a laundry dryer are described. Elements and features corresponding to the above schematically depicted dryer 2 of FIGS. 1 to 3 are marked with corresponding reference signs. Unless otherwise mentioned, the elements, features and functions of the below described embodiments correspond to the above described elements, features and functions.

Figure 5A:
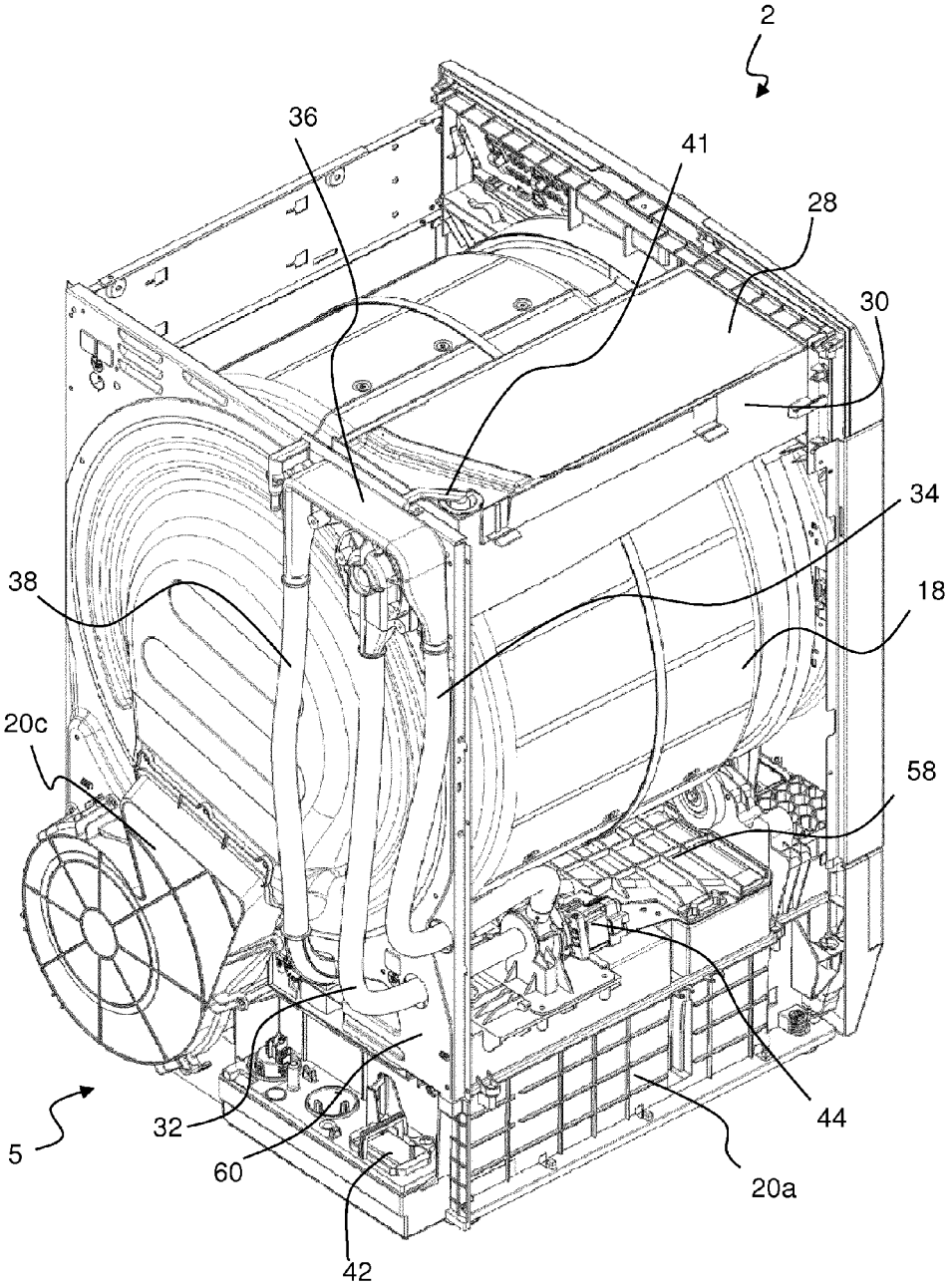
Figure 5B:
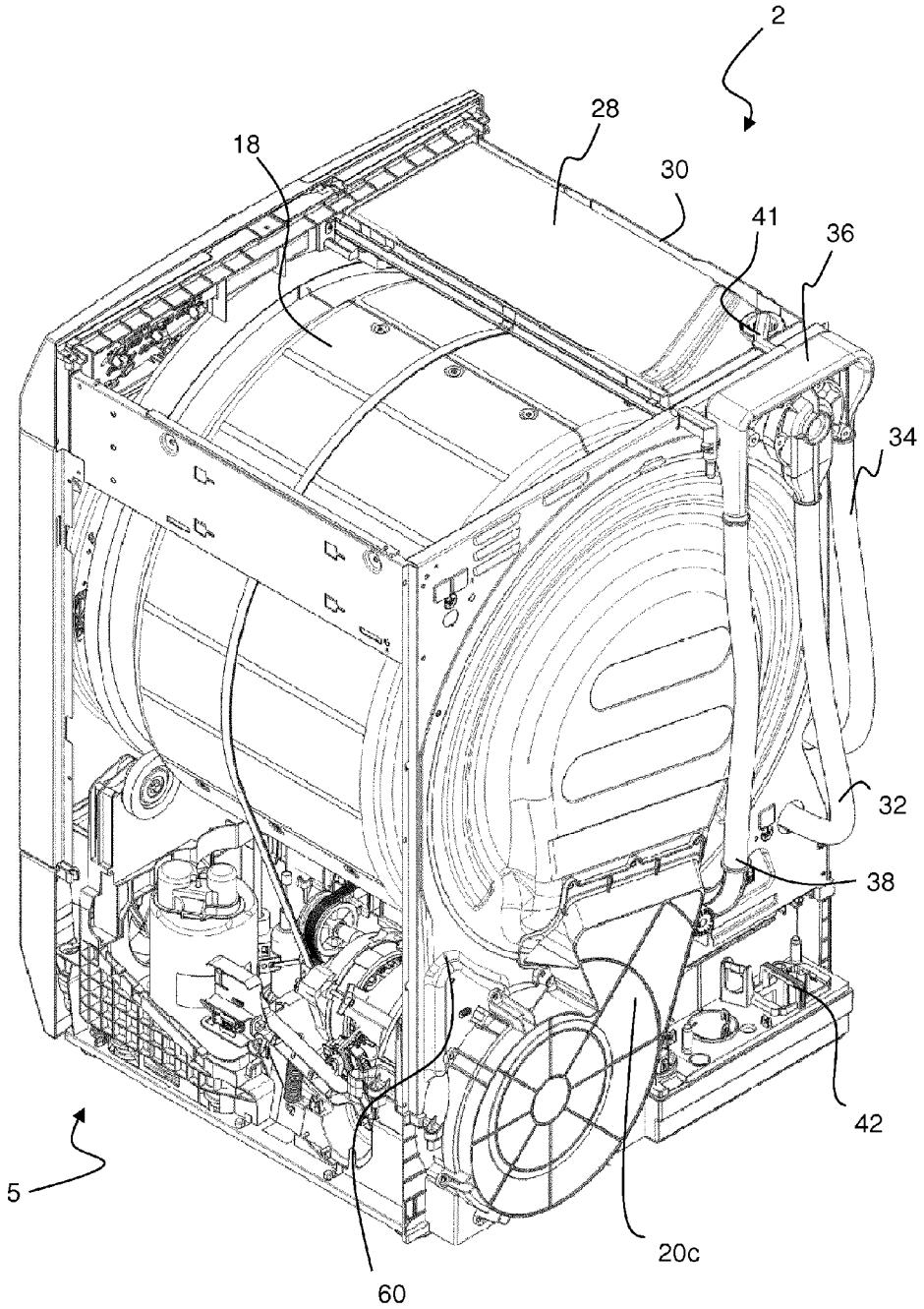

FIG. 4 shows a front view of a dryer 2 comprising an input panel 7 for user input and an outer casing 3 or housing having a loading door 15 for loading laundry to be dried into the drum 18 arranged in the casing 3. FIGS. 5*a-b* show perspective rear views of the dryer of FIG. 3, wherein the top and side portions of the casing 3 are removed to show the arrangement of dryer components.

The reservoir compartment 30 is arranged at a top portion of the dryer 2, wherein the extractable reservoir 28 is inserted into the compartment 30. At the rear of the compartment 30 the supply line 32 can be seen which runs from the reservoir 28 or compartment 30 down to the flushing pump 44. From the flushing pump 44 the rising portion 34 of the supply line is guided back up. The communicating portion 36 of the supply line is arranged above a highest liquid level of the reservoir 28 as described above and is formed in a space-saving manner as a flat pipe. The descending portion 38 of the supply line 32 is guided downwards towards the flushing duct 58 which is arranged on top of the battery channel 20*a* which houses the first and second heat exchanger 10, 12.

The drain pump 42 is arranged at a bottom rear portion of the base section 5 of the dryer. The drain pump 42 pumps liquid from the condensate collector 26 (FIGS. 6*b-c*) to the reservoir 28 as described above.

Figure 6A:
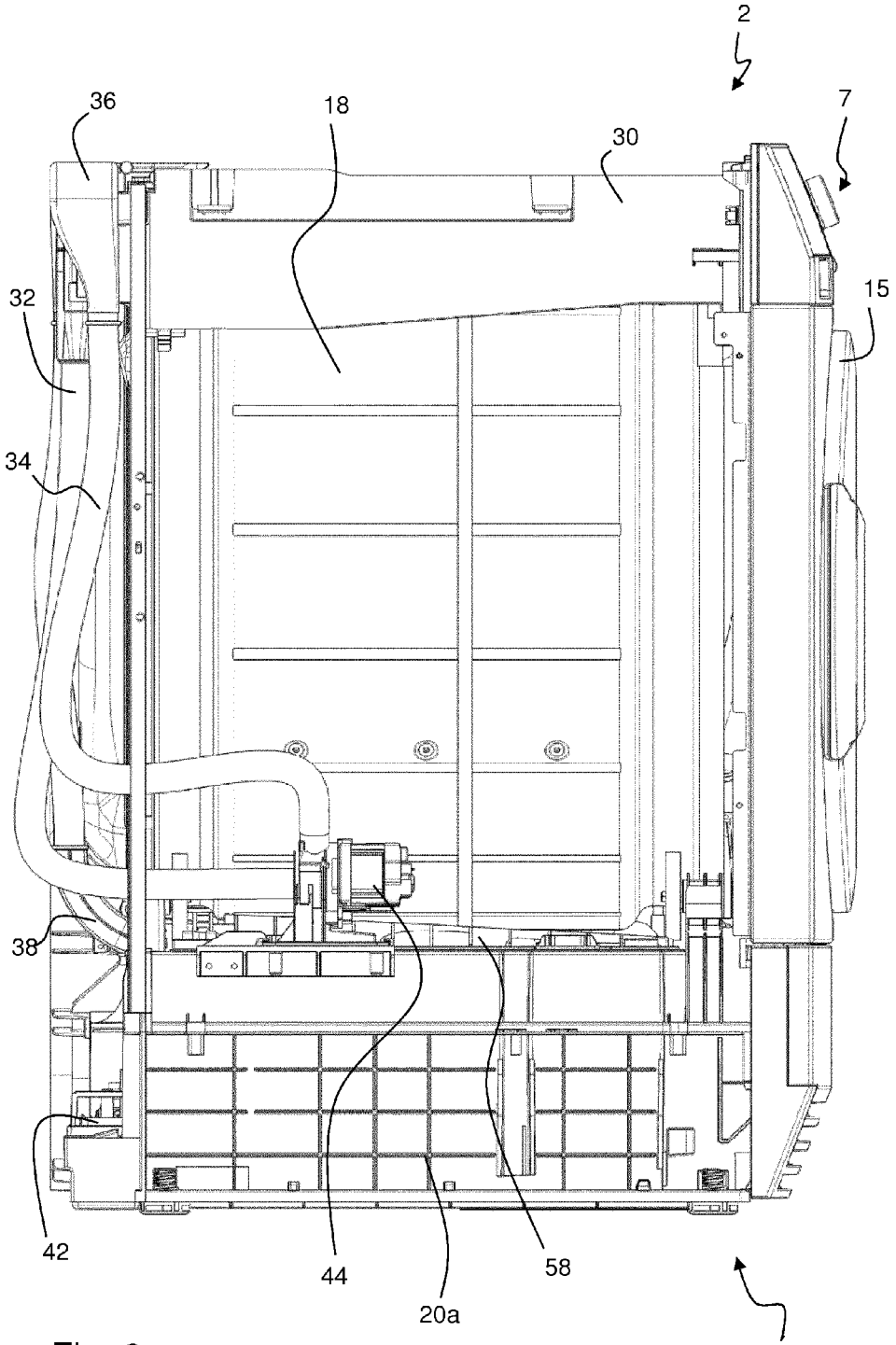
Figure 6B:
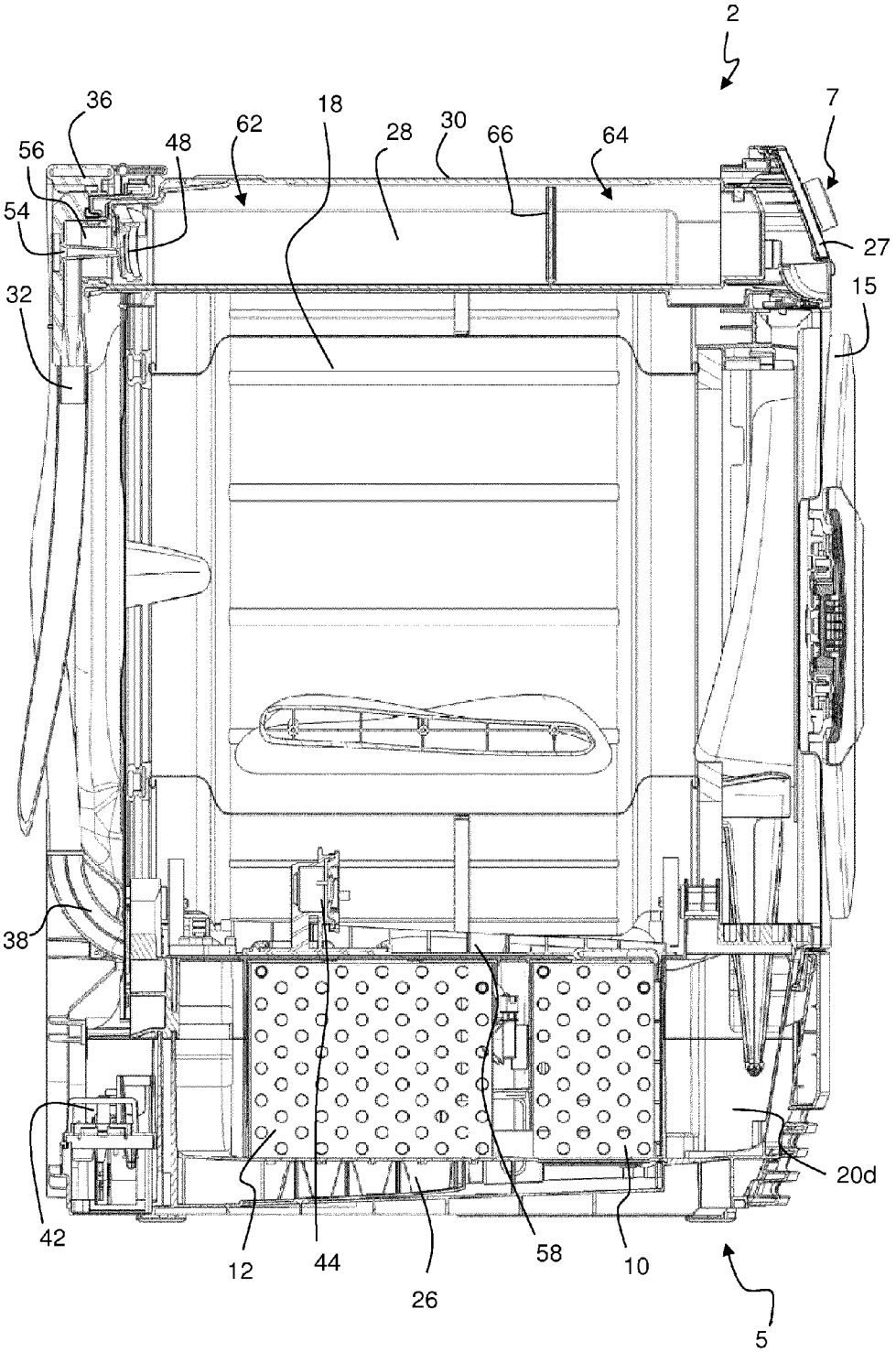
Figure 6C:
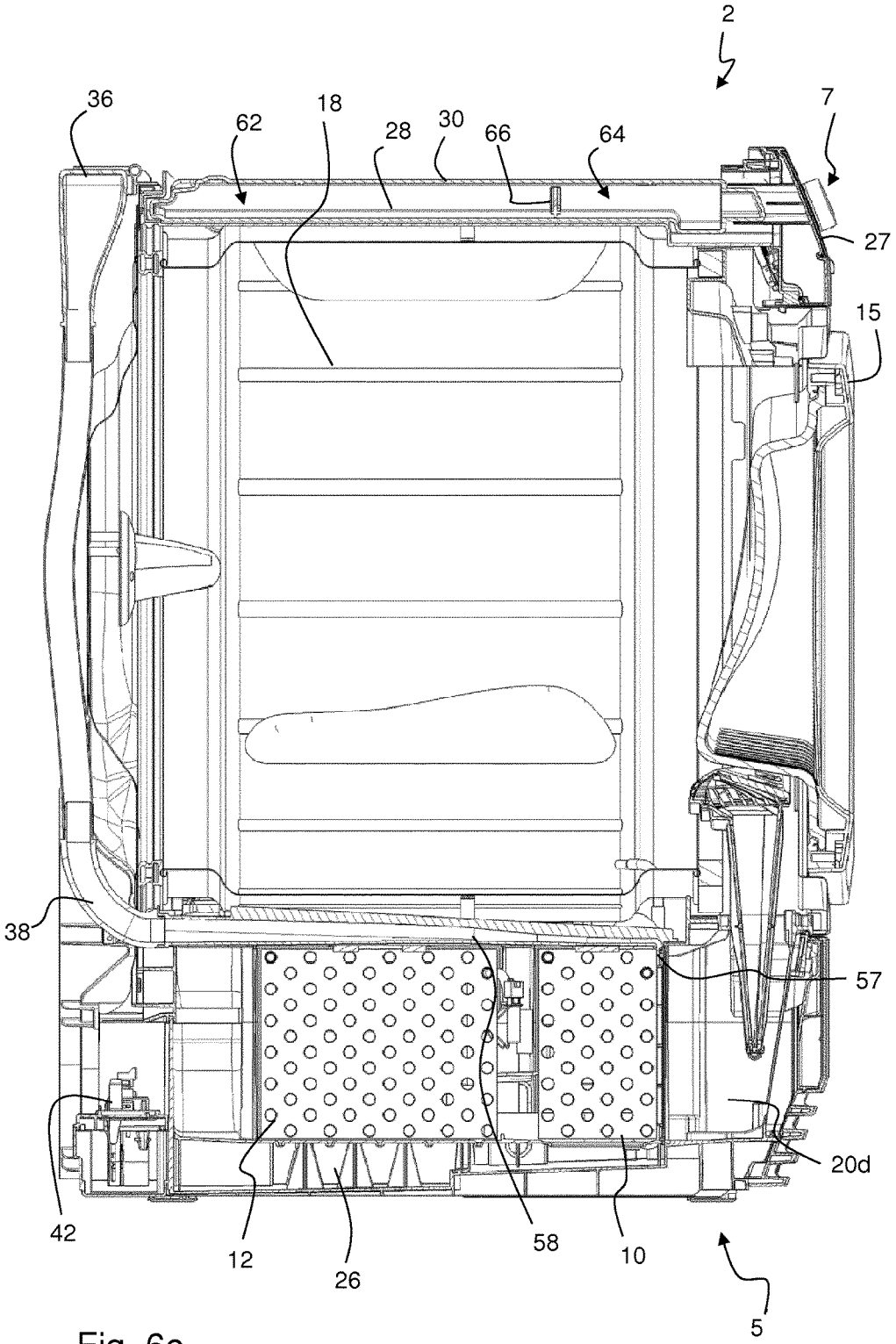

FIGS. 6*a-c* show a side view and sectional side views of the dryer of FIG. 3. FIG. 6*a* shows a side view of the dryer 2, wherein the side cover or casing 3 is removed. FIGS. 6*b* and 6*c* show sectional side views of the dryer 2. FIG. 6*b* shows a sectional side view in the plane of the reservoir outlet 29 and FIG. 6*c* a sectional side view in a plane of the descending portion 38 of the supply line 32.

When the reservoir 28 is inserted, the reservoir outlet 29 (i.e. the closing element 48) is permanently opened as described above. In particular the coupling arrangement 54 comprises an actuating element in form of a protruding bolt or pin which opens the closing element 48 by pushing it open when inserting the reservoir 28 into the reservoir compartment 30.

As shown in FIG. 6*c*, the descending portion 38 of the supply line 32 opens into the flushing duct 58 which is arranged on top of the battery channel 20*a*. The duct 58 comprises a nozzle 57, i.e. the supply line outlet, which is arranged above a front surface of the first heat exchanger 10. I.e. when liquid is supplied through the supply line 32, the front surface of the heat exchanger 10 is rinsed or washed as described above.

The condensate collector 26 is arranged below the heat exchangers 10, 12 and extends to the back or rear of the dryer 2 where the drain pump 42 is arranged, which pumps the collected liquid back into the reservoir 28 as described above.

Figure 7:
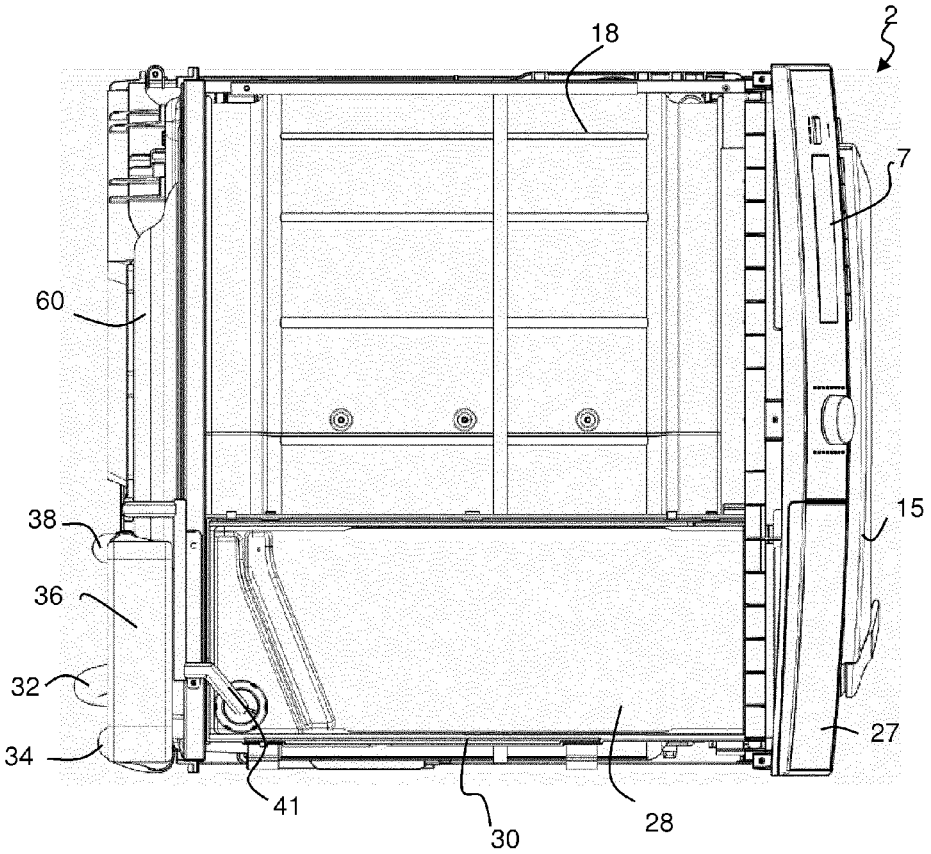
Figure 8:
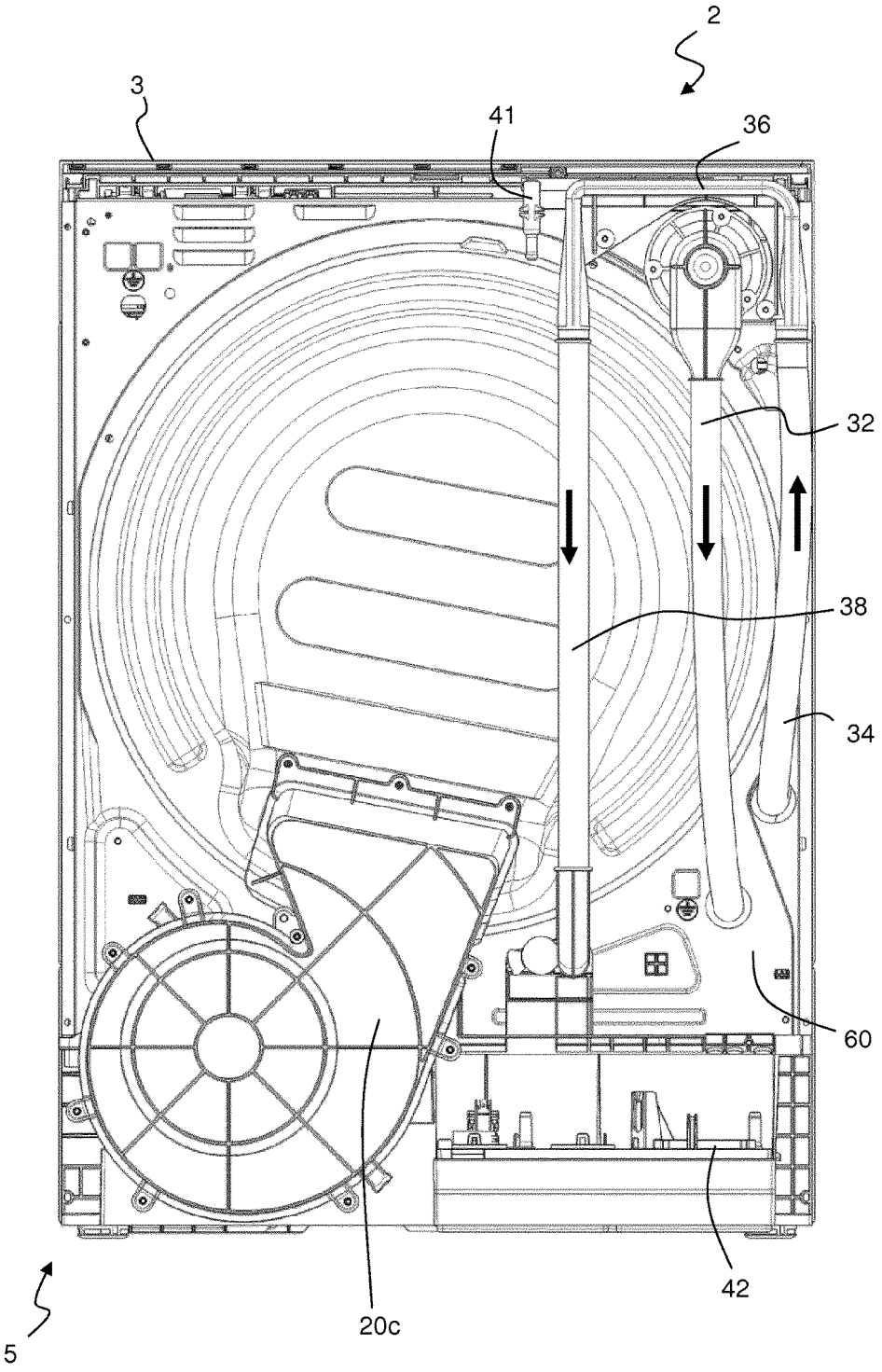

FIG. 7 shows a top view and FIG. 8 a rear view of the dryer 2 of FIG. 3. In FIG. 8 the flow direction of the conveyed liquids during a rinsing operation are indicated by arrows. As shown in FIG. 7, the collector drain pipe 41 opens into the reservoir inlet which is arranged on top of the reservoir 28. The portion of the collector drain pipe 41 running across the rear of the dryer 2 has been omitted for clarity.

Figure 9:
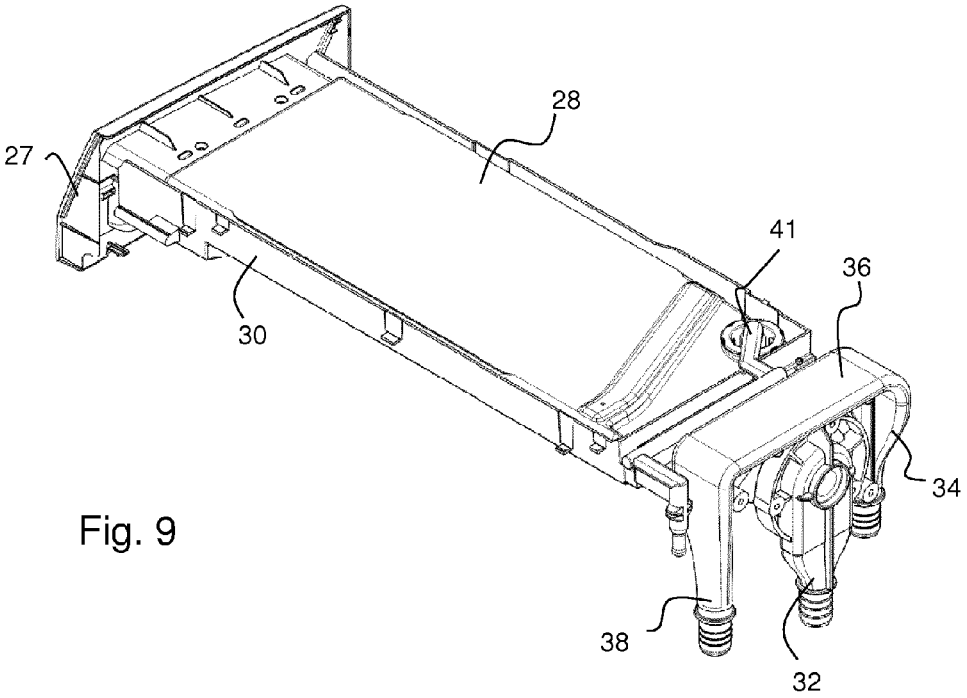

FIG. 9 shows a perspective top view of the reservoir and reservoir compartment 30 of the dryer 2 of FIG. 3. In this embodiment portions of the supply line 32 are arranged at the rear of the compartment 30 in a space-saving manner. In particular the communication portion 36 is formed in one piece with a portion of the rising and descending portions 34, 38, wherein each end comprises a connecting socket or pipe socket for attaching thereto a (flexible) hose which forms the remaining part of the supply line 32.

Figure 10A:
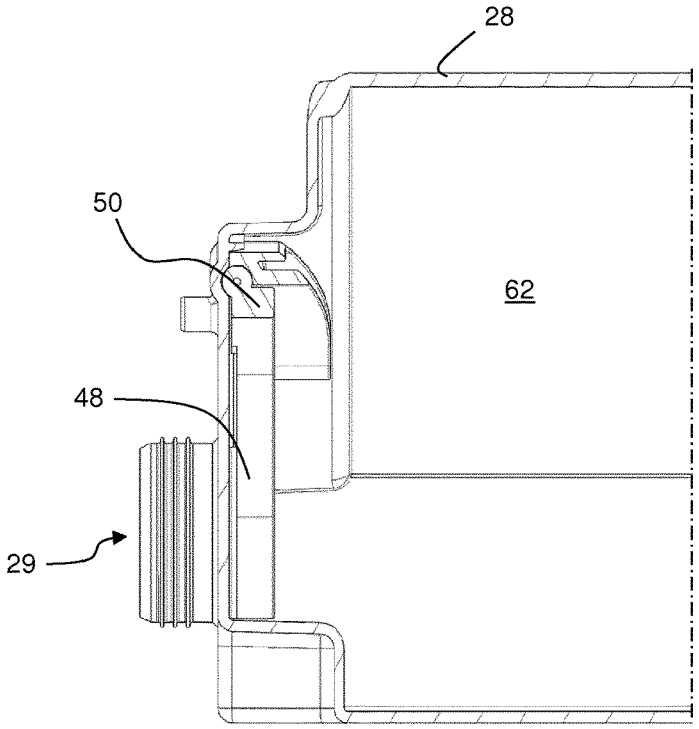
Figure 10B:
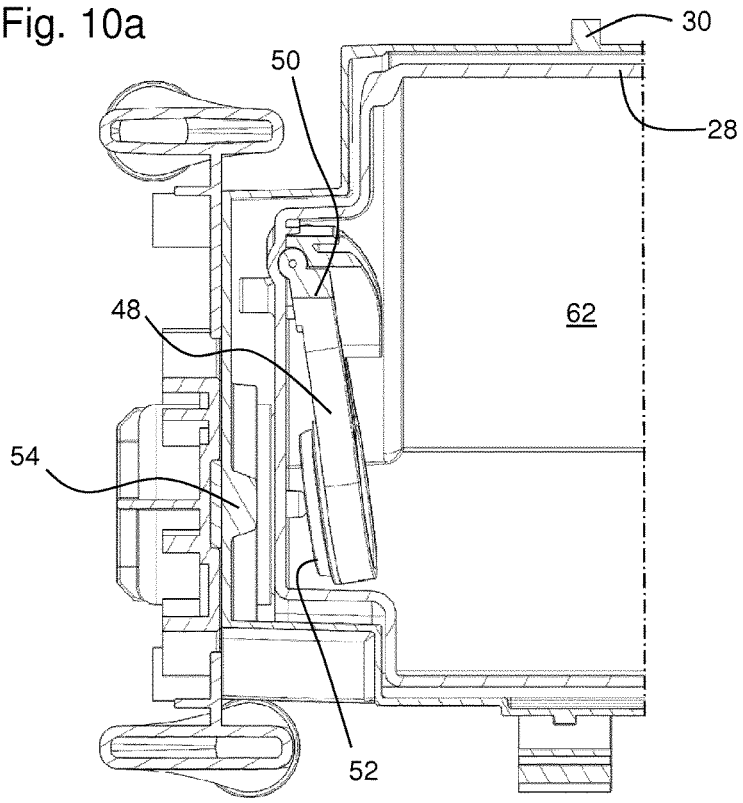

FIG. 10*a* shows a sectional top view of a portion of the condensate reservoir 28 and FIG. 10*b* shows a sectional top view of a portion of the reservoir 28 inserted into the reservoir compartment 30. In FIG. 10*a* the closing element 48 is closed as the reservoir 28 is removed from the compartment 30, i.e. the closing element 48 provides that collected liquid in the reservoir 28 is safely retained. The closing element 48 comprises a spring-biased lever 50 which pushes the closing element 48 against the inner wall of the reservoir 28.

FIG. 10*b* shows the reservoir 28 when completely inserted in the reservoir compartment 30, i.e. the reservoir 28 is in its operating position. The coupling arrangement 54, here the protruding pin pushes the closing element 48 into the reservoir 28 such that the reservoir outlet 29 is opened and the reservoir 28 is fluidly connected to the supply line 32.

Figure 11A:
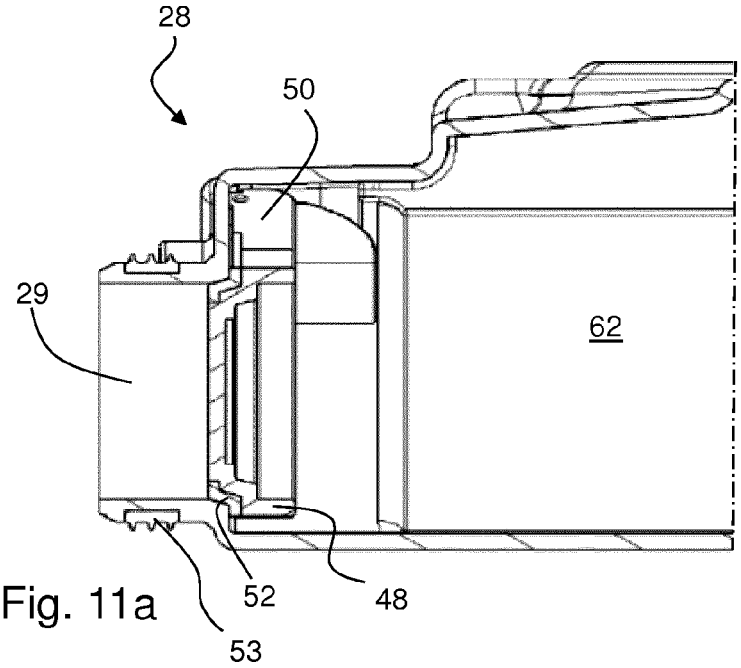
Figure 11B:
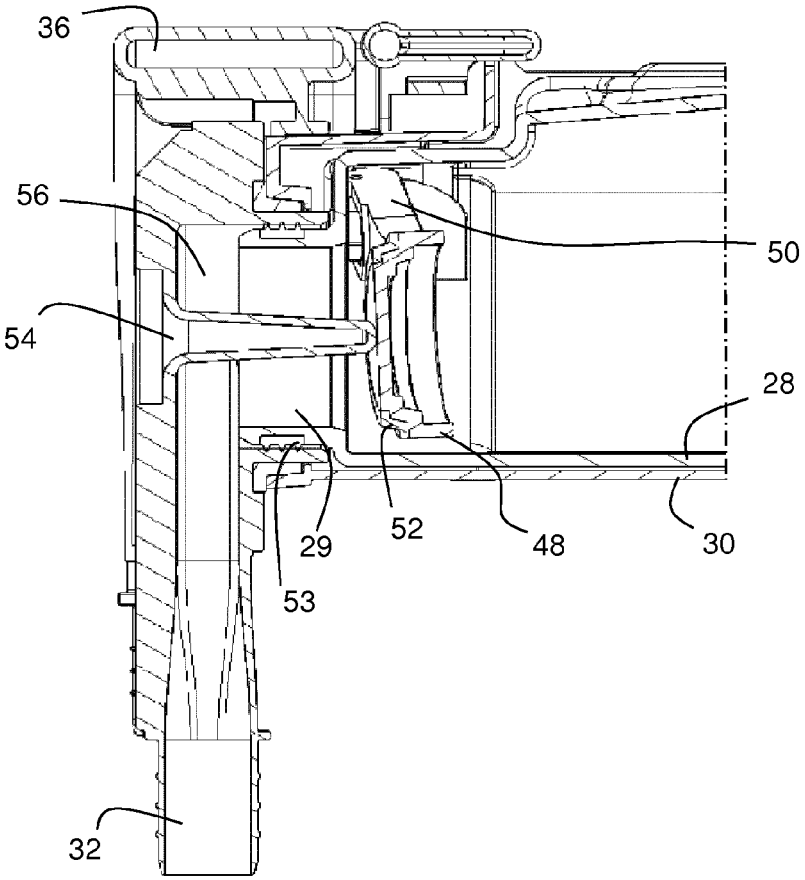

Corresponding to FIGS. 10*a-b*, FIGS. 11*a-b* show sectional side views of the removable condensate reservoir 28 (FIG. 11*a*) and of the reservoir 28 inserted into the reservoir compartment 30 (FIG. 11*b*). In FIG. 11*a* an elastic sealing element 52 of the closing element 48 can be seen which abuts at a sealing surface of the reservoir 28 to provide a leak-proof seal when the reservoir 28 is pulled out of the compartment 30. In FIGS. 11*a-b* an elastic sealing element 53 is present which is provided to prevent leakage of water when the removable reservoir is in communication with the supply line housing 32.

Figure 12A:
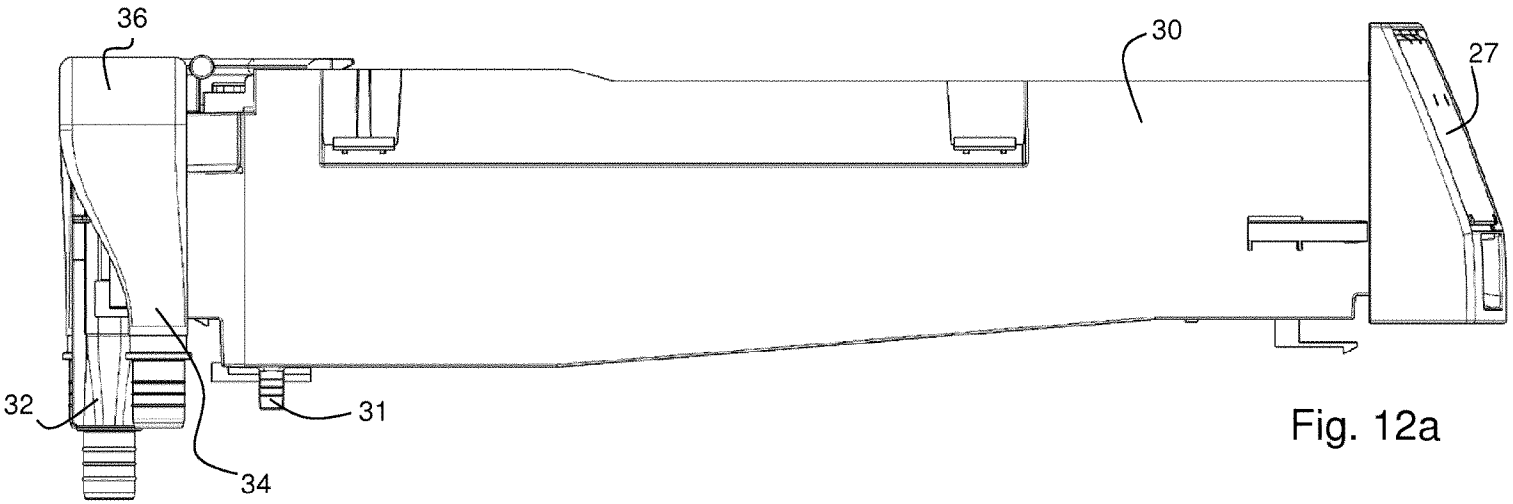
Figure 12B:
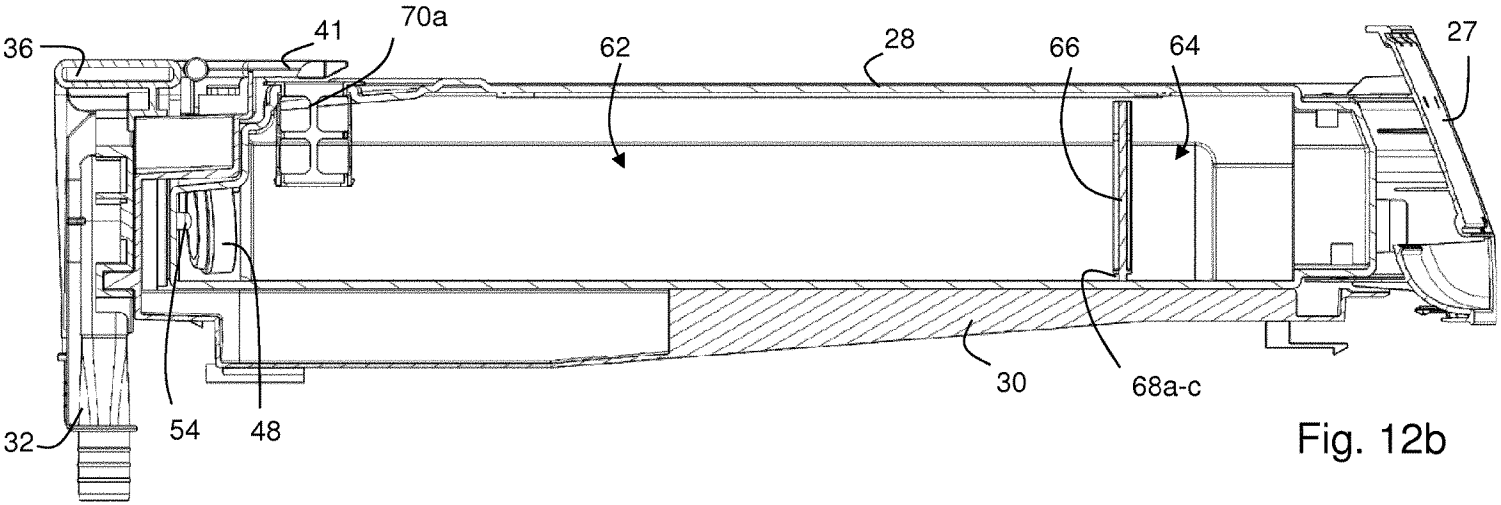

FIGS. 12*a-b* show a side view and a sectional side view of the reservoir compartment 30 with inserted condensate reservoir 28. In FIG. 12*b* the first and second compartments 62, 64 are shown with the separating wall 66 between them. The separating wall 66 comprises the liquid passage 68*a-c* in form of several pinholes (FIG. 13*c*) close to the bottom of the reservoir 28. Further a filter element 70*a* is arranged at the inlet of the reservoir 28, i.e. at the outlet of the collector drain pipe 41. Thus liquid is filtered before being collected in the reservoir 28. The filter element 70*a* which is associated to the reservoir 28 can be easily cleaned when the reservoir 28 is extracted from or pulled out of the compartment 30.

FIGS. 13*a-c* show a rear view and sectional views of the reservoir 28 and reservoir compartment 30. FIG. 13*a* shows a rear view of the compartment with the supply line 32 arrangement attached thereto. In FIG. 13*b* the supply line 32 arrangement is omitted, such that the position of the inserted reservoir 28 can be seen. FIG. 13*c* is a sectional front view which shows the separating wall 66 and the pinholes forming the liquid passage 68*a-c* between the first and second compartment 62, 64 as described above.

Figure 14A:
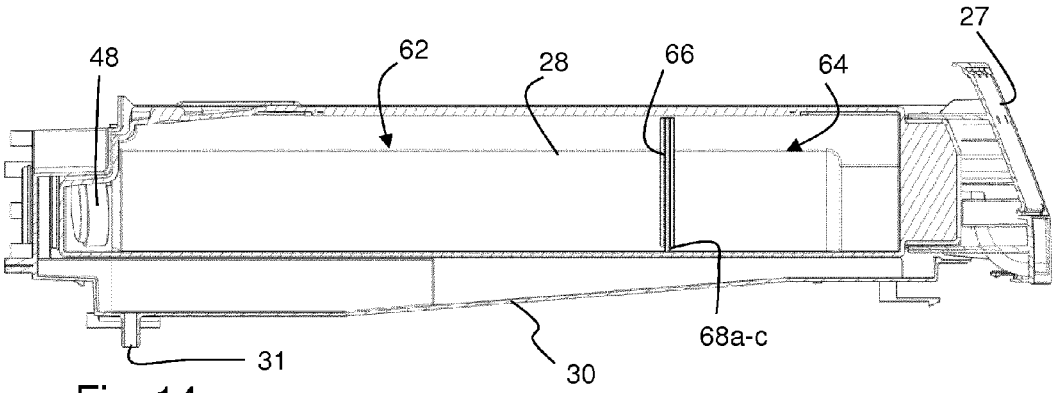
Figure 14B:
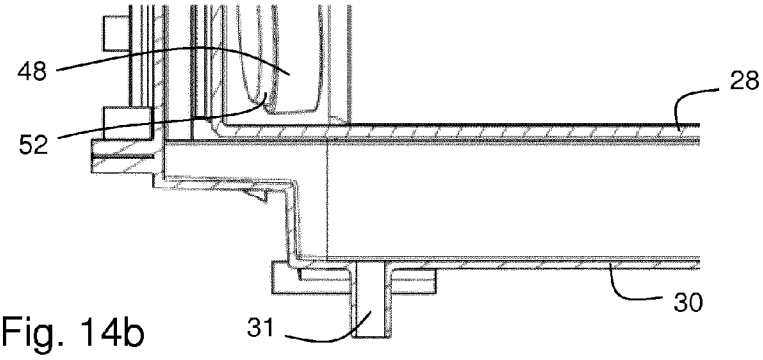

FIGS. 14*a-b* show a sectional side view and detail of the reservoir 28 and reservoir compartment 30 in the plane of the outlet 31 of the compartment 30. It can be seen that the outlet 31 is formed as a pipe socket at the lowest portion of the compartment 30 which is permanently open. I.e. it is provided that any spilled liquid is immediately drained from the compartment 30 via outlet 31 and drain pipe 46 into the condensate collector 26 as described above.

Figure 15A:
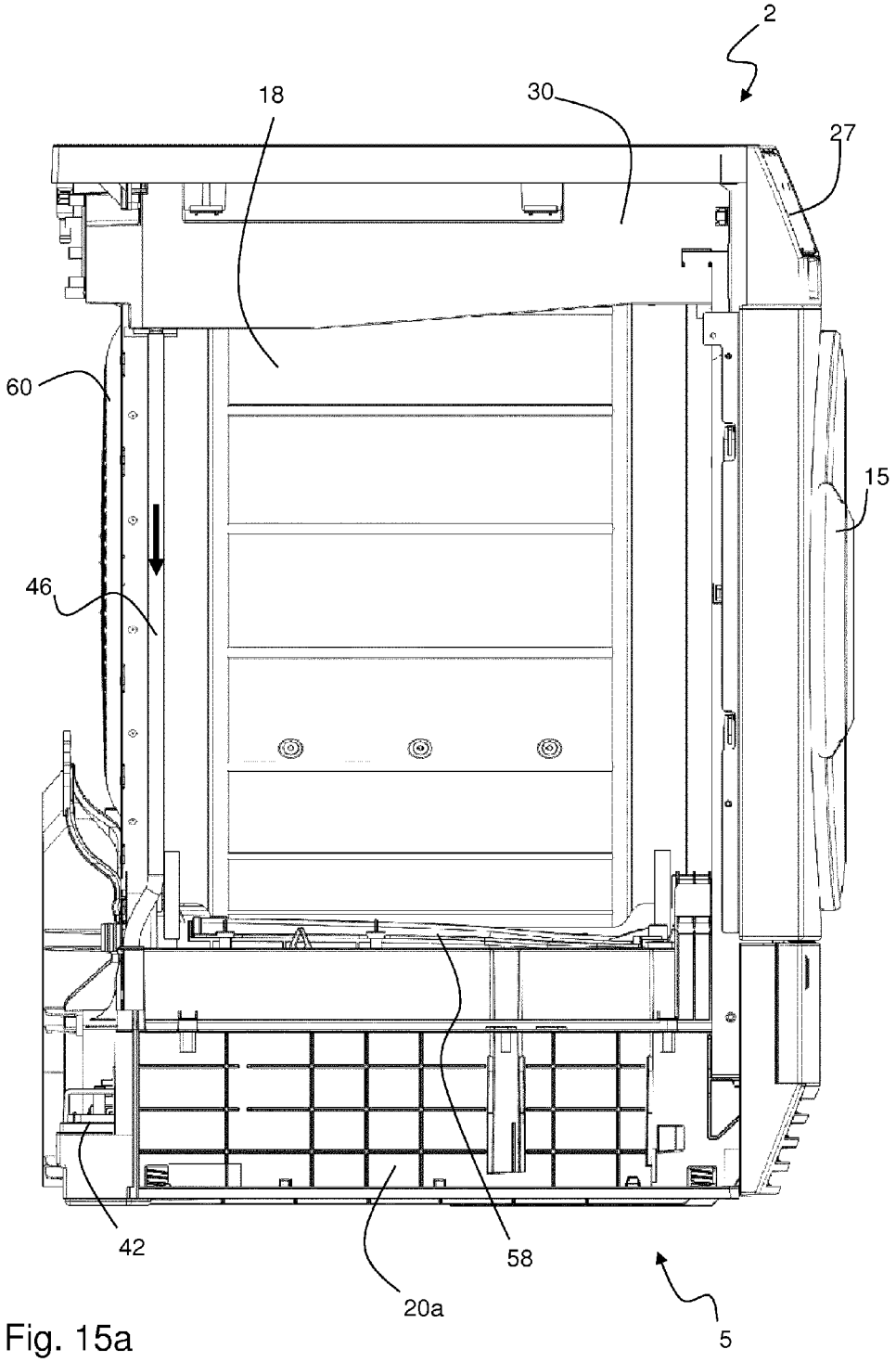
Figure 15B:
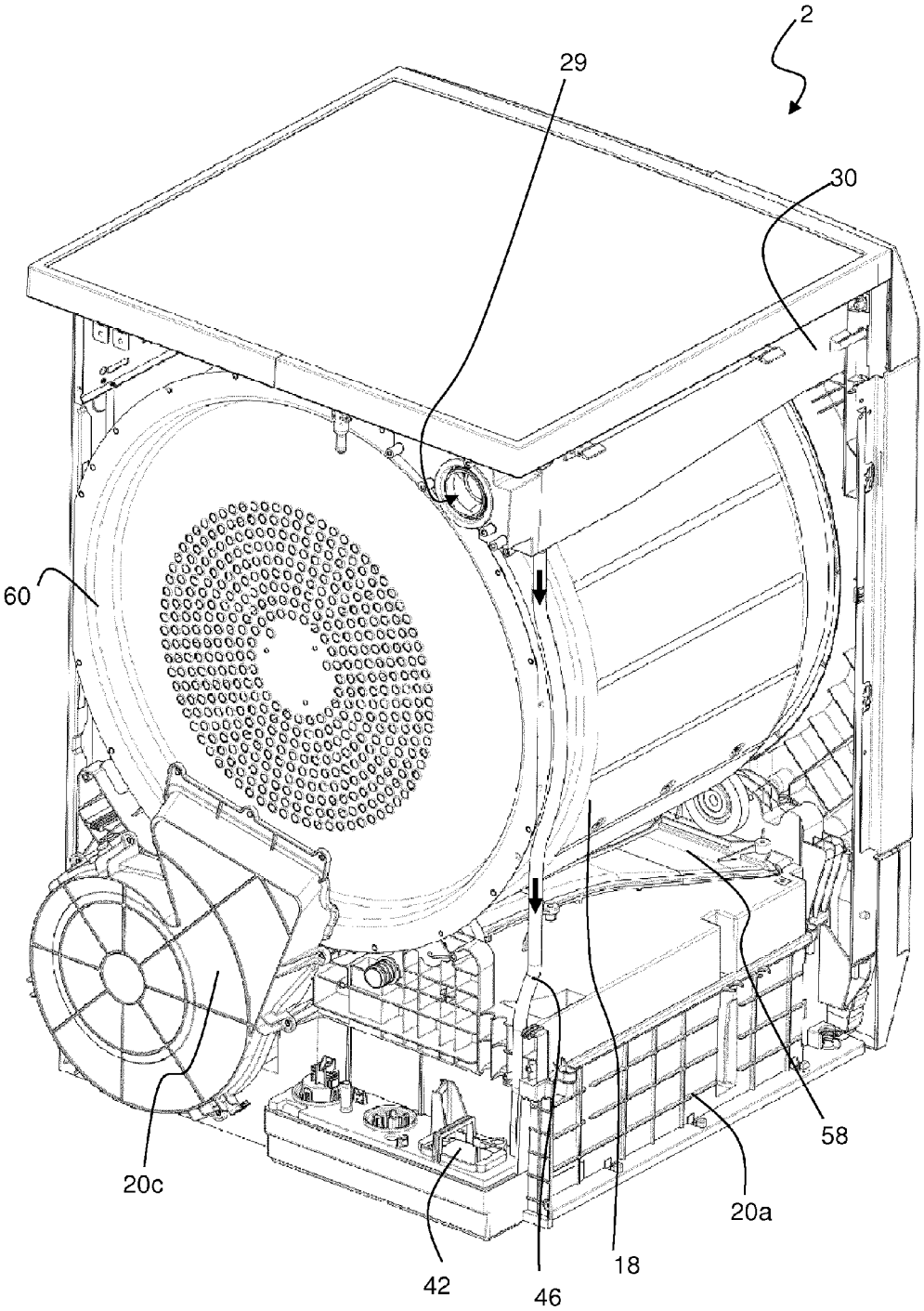
Figure 15C:
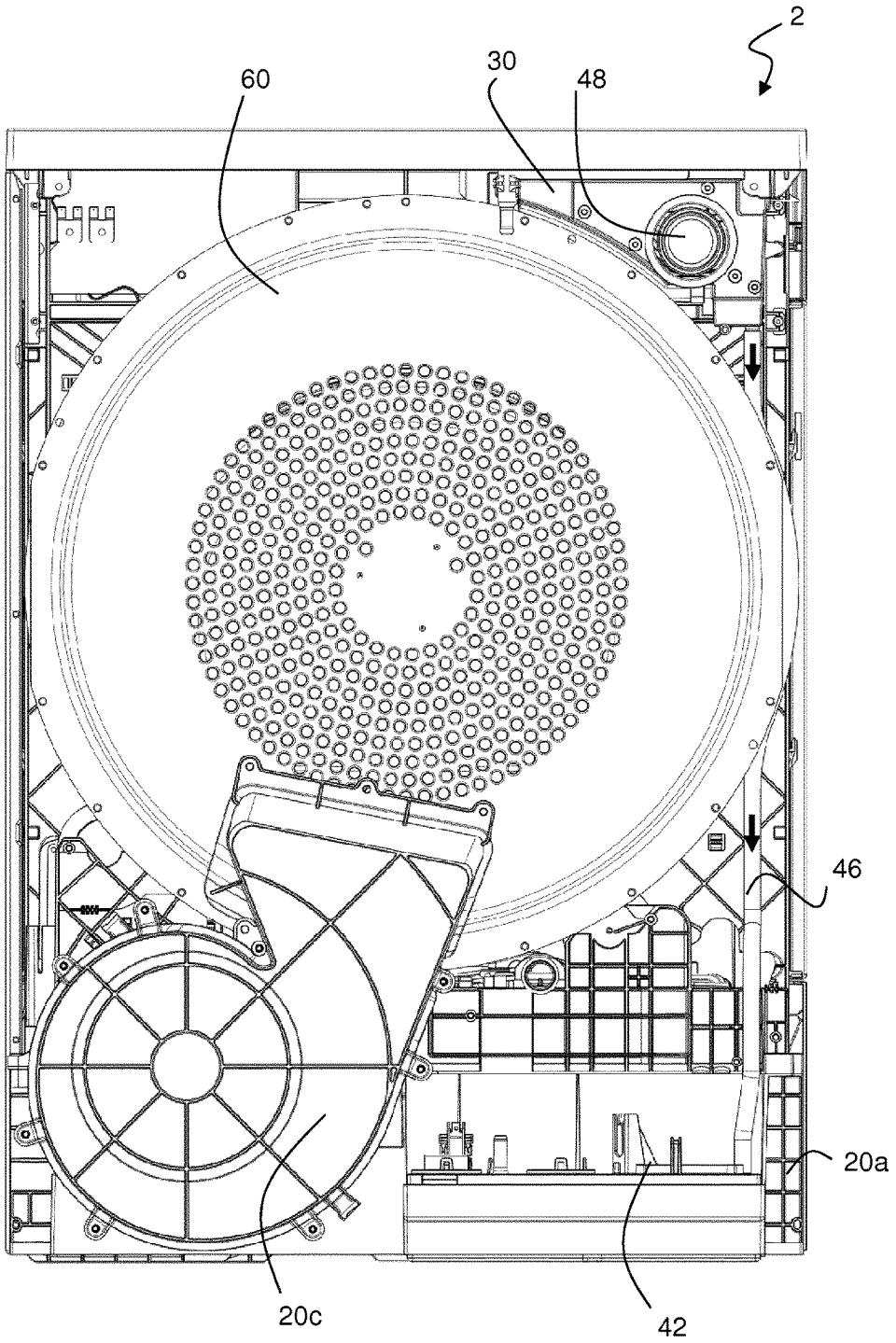

FIGS. 15*a-c* show a side view, a perspective view and a rear view of the dryer 2 of FIG. 3, wherein the supply line 32 is omitted to illustrate the arrangement of the drain pipe 46 connecting the compartment 30 to the condensate collector 26. The compartment drain pipe 46 is connecting the reservoir compartment outlet 31 (FIG. 14*b*) to the condensate collector 26, wherein the drain pipe 46 is guided vertically or essentially vertically downwards from the outlet 31 towards the condensate collector 26. I.e. liquid is guided by means of gravity in the shortest (and fastest) possible way into the collector 26, wherein due to the vertically arranged drain pipe 46 and therefore high flow rates the risk of clogging the drain pipe 46 is reduced.

Figure 16A:
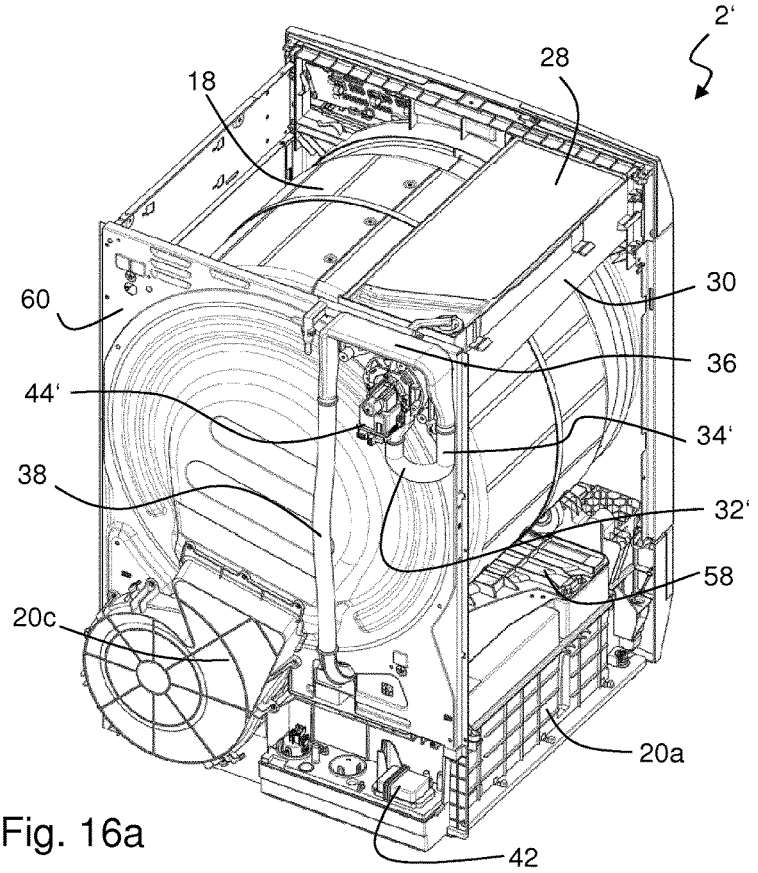
Figure 16B:
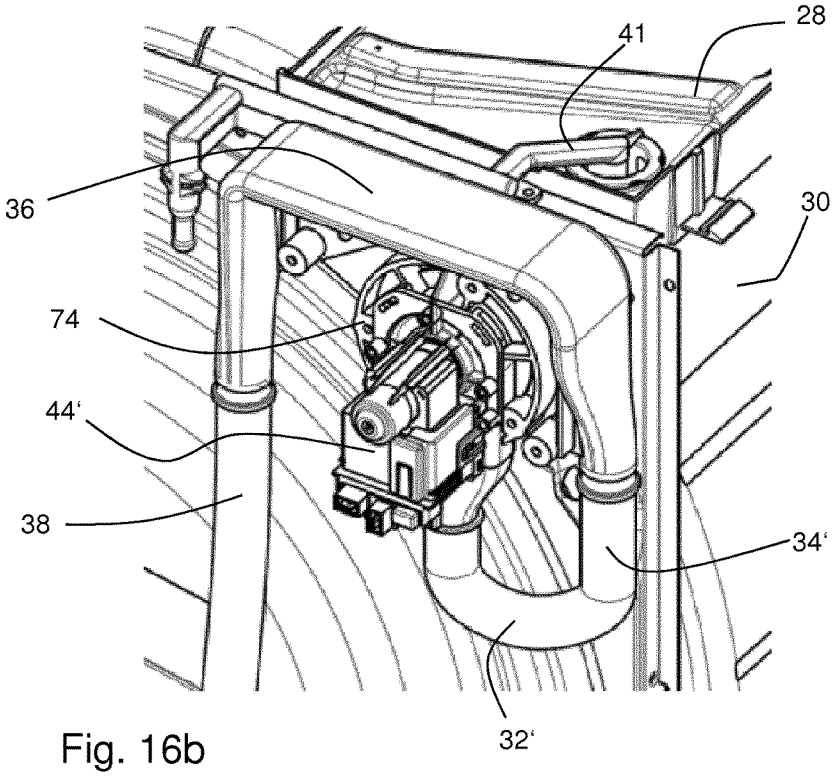

FIGS. 16*a-b* show a perspective rear view and a detail of a dryer 2' according to a further embodiment. Unless otherwise mentioned, elements, features and functions of the dryer 2' correspond the elements, features and functions of the dryer 2 described above.

In contrast to the above described dryer 2, the dryer 2' of FIG. 16 comprises a flushing pump 44' which is arranged behind the backside or rear of the compartment 30. In particular the outlet 29 of the reservoir 30 is directly connected to the flushing pump 44' with a minimum of supply line 32 or pipe inbetween. In this embodiment the supply line 32 is considerably shorter than in the embodiment above. Due to shorter supply line 32 or pipes the pressure drop during the operation of the flushing pump 44' is reduced. Further, less liquid remains in the dryer after a drying cycle, as the rising portion 34' of the supply line 32 is much shorter than in the above embodiment. The flushing pump 44' is supported by a supporting structure 74 which is arranged here at the rear side wall or region of the reservoir compartment 30.

FIGS. 17*a-d* show perspective views and sectional side views of an alternative coupling arrangement 54' for a condensate reservoir 28'. The condensate reservoir 28' and its coupling to the supply line 32 as described in the following may be implemented in any of above described embodiments of dryers 2, 2'. In FIGS. 17*a-d* the reservoir compartment for housing the reservoir 28' is not depicted. Unless otherwise mentioned the elements, features and components of the above described reservoir 28 and compartment 30 may be implemented in the below described embodiment of the reservoir 28'. For example the reservoir inlet or compartment outlet 31 may be implemented in the below described reservoir 28' and corresponding compartment.

Figure 17A:
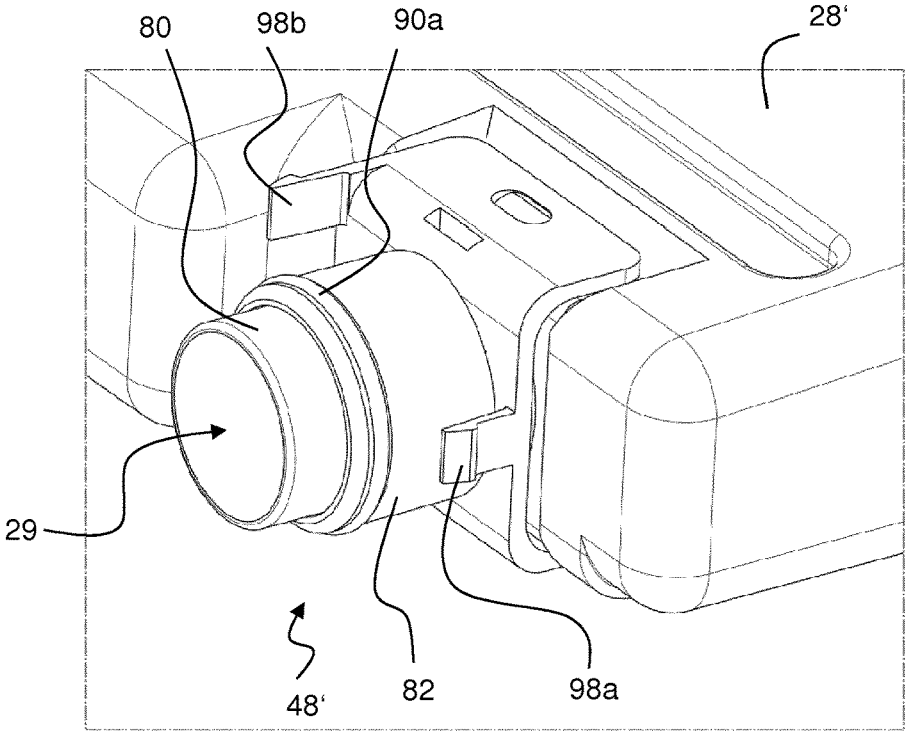
Figure 17B:
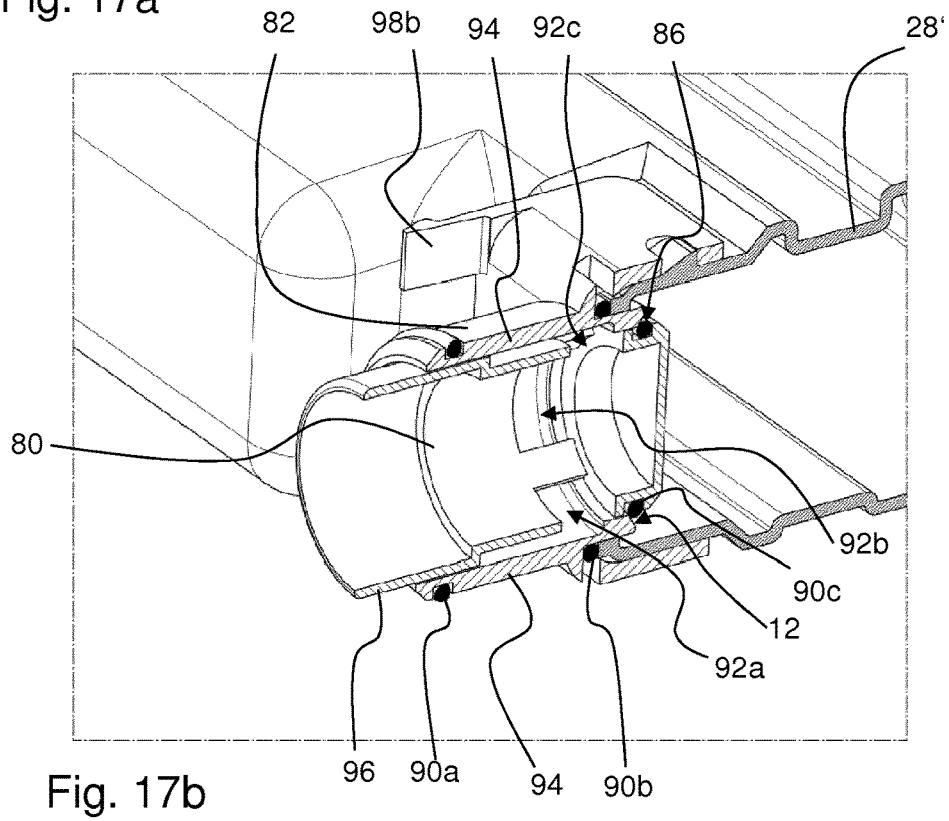

FIG. 17*a* shows a perspective view of a detail of the reservoir 28' with a closing element or valve 48' in a closed state and FIG. 17*b* shows a sectional view of the detail. The valve 48' comprises a (stationary) valve body 82 which is connected or fixed to the reservoir 28' or main body of the reservoir 28', wherein locking hooks 98*a-b* are provided which are formed integrally with the valve body 82. Within the valve body 82, in particular in a body pipe section 94 of the valve body 82, a moveable valve element 80 is guided. The valve element 80 comprises an element pipe section 96 which is guided by the valve body 82, i.e. the body pipe section 94 of the valve body 82. An outer surface of the element pipe section 96 is guided on or slides along an inner surface of the body pipe section 94, e.g. when the valve element 80 is pushed into the valve body 82 when inserting the reservoir 28' into the compartment 30. The valve element 80 comprises a hollow profile portion, in particular a hollow profile end portion which faces into the reservoir 28'. The hollow profile portion comprises four passages 92*a-c* (only three visible in FIG. 17*b*) through which the reservoir 28' is filled and emptied, i.e. through which the condensate flows when the reservoir 28' is inserted in the dryer 2, 2' and the condensate is discharged after extracting the reservoir 28' from the dryer 2, 2'.

The valve 48' comprises several gaskets 90*a-c* in form of O-rings. Gasket 90*c* is arranged on the moveable valve element 80 and provides a tight sealing between a first sealing surface 84 (FIG. 17*d*) of the valve body 82 and a second sealing surface 86 of the valve element 80. A spring element 88 (FIG. 17*c*) provides that the valve element 80 and the valve body 82, i.e. the respective sealing surfaces 84, 86, are pressed tightly together when the reservoir 28' is extracted from the dryer 2, 2' or reservoir compartment, such that the valve is in the closed state and stored condensate cannot be spilled accidentally.

Figure 17C:
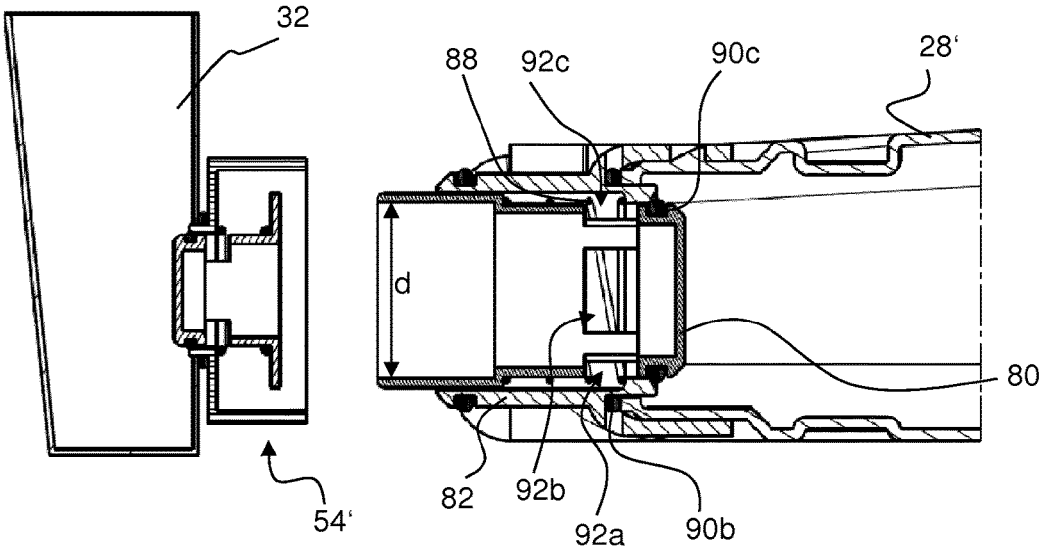

FIG. 17*c* shows a cross-sectional side view of the reservoir 28' before coupling the reservoir 28' to a coupling arrangement 54' attached to the supply line 32 or supply line inlet 56. The spring element 88 pushes the valve element 80, i.e. the second sealing surface 86, against the first sealing surface 84 of the valve body 82, such that the valve 48' is in the closed state. The (open) end of the moveable valve element 80 facing the outside of the reservoir 28' has a maximum outlet diameter d. When actuating the valve 48', the valve element 80 is pushed along the valve axis into the (stationary) part of the valve 48', i.e. the valve body 82. An actuation length of the valve element 80, i.e. the length the valve element 80 that has to be moved from the closed valve state to the (completely) open valve state, is in the range of 5 mm to 15 mm. In particular the valve 48' is (completely) open when the complete cross-section of all passages 92*a-c* is exposed to the inner volume of the reservoir 28'.

Figure 17D:
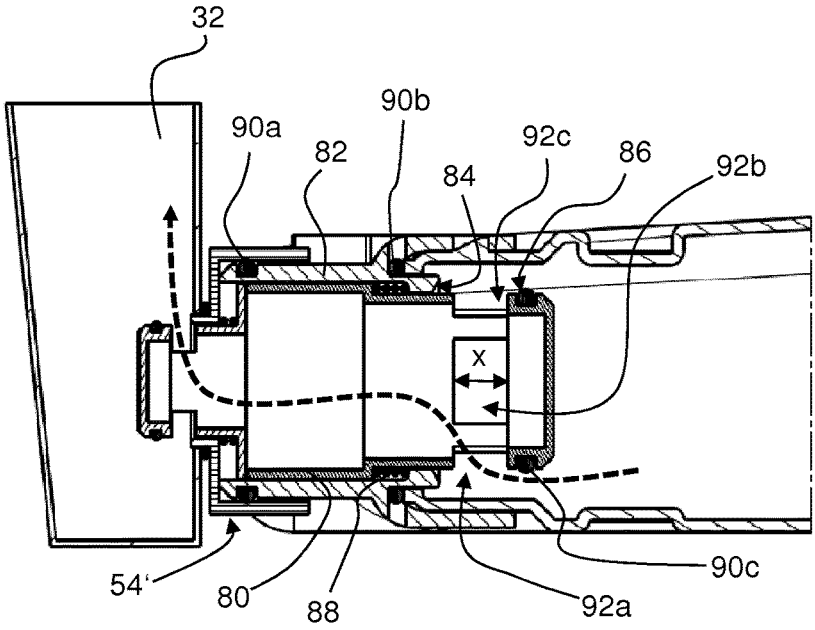

FIG. 17*d* shows a cross-sectional side view of the reservoir 28' after coupling the reservoir 28' to the coupling arrangement 54' arranged at the supply line inlet 56, i.e. after fully inserting the reservoir 28' in its compartment. The valve 48' is actuated, i.e. the valve element 80 is pushed into the valve body 82 such that the passages 92*a-c* are exposed to the interior of the reservoir 28', i.e. the valve is in the open state. In particular the actuation length of the valve element 80 is selected such that at the end of the actuation movement the passages 92*a-c* are fully exposed.

In particular the sum of the cross-sections of all passages 92*a-c* is equal to or approximately equal to the cross-section of the maximum axial opening of the valve element 80. Thus a free flow of water through the valve 48' during discharging the reservoir 28' is provided. The water flow through the valve 48' is not or is essentially not constricted. For manually draining the reservoir 28', the reservoir 28' is extracted from its compartment, whereby the valve 48' is closed. Then the valve 48' may be opened by pushing it by hand or by pushing it against a surface, such that the collected liquid may be drained through the opened valve 48'. By providing several passages 92*a-c* through the valve element profile section the counter-flow of air during discharging the reservoir 28' is facilitated, whereby the discharging time for the reservoir 28' is reduced.

| Reference Numeral List | |
|---|---|
| 2, 2' | heat pump tumble dryer |
| 3 | casing/housing |
| 4 | heat pump system |
| 5 | base section |
| 6 | refrigerant loop |
| 7 | input panel |
| 8 | blower |
| 9 | control unit |
| 10 | first heat exchanger (evaporator) |
| 12 | second heat exchanger (condenser) |
| 14 | compressor |
| 15 | loading door |
| 16 | expansion device |
| 17 | drum motor |
| 18 | drum (laundry compartment) |
| 19 | laundry |
| 20 | process air channel |
| 20a | battery channel |
| 20b | rear channel |
| 20c | rising channel |
| 20d | front channel |
| 22 | fluff filter |
| 24 | cooling air blower unit |
| 26 | condensate collector/basement tank |
| 27 | condensate reservoir front |
| 28, 28' | condensate reservoir/drawer |
| 29 | reservoir outlet |
| 30 | reservoir compartment |
| 31 | reservoir compartment outlet/pipe socket |
| 32, 32' | supply line |
| 34, 34' | rising portion |
| 36 | communicating portion |
| 38 | descending portion |
| 40 | filter element |
| 41 | drain pipe (condensate collector) |
| 42 | drain pump |
| 44, 44' | rinsing/flushing pump |
| 46 | drain pipe (reservoir compartment) |
| 48, 48' | closing element/valve |
| 50 | spring lever |
| 52 | elastic sealing element |
| 53 | elastic sealing element on removable reservoir |
| 54, 54' | coupling arrangement/actuating element |
| 56 | supply line inlet/stub |
| 57 | supply line outlet/nozzle |
| 58 | flushing duct |
| 60 | rear wall/rear frame |
| 62 | first compartment |
| 64 | second compartment |
| 66 | separation wall |
| 68a-c | liquid passage/pin hole |
| 70a-e | filter element |
| 74 | supporting structure (flushing pump) |
| 80 | movable valve element |
| 82 | valve body |

-continued

| Reference Numeral List | |
|---|---|
| 84 | first sealing surface |
| 86 | second sealing surface |
| 88 | spring element |
| 90a-c | gasket |
| 92a-c | passage |
| 94 | body pipe section |
| 96 | element pipe section |
| 98a-b | locking hook |
| A | process air flow |
| B | refrigerant flow |
| R | refrigerant |

The invention claimed is:

1. Laundry dryer comprising:

a casing, a laundry storing compartment arranged within the casing for receiving laundry to be dried by passing process air through the laundry storing compartment, a heat exchanger for dehumidifying the process air after passing the laundry storing compartment, a removable condensate reservoir for storing condensed water formed at the heat exchanger, a drain pump to pump the condensed water formed at the heat exchanger to the removable condensate reservoir through a drain line, the removable condensate reservoir having a reservoir outlet for draining condensate liquid stored therein and a closing element for closing the reservoir outlet when the removable condensate reservoir is extracted from a reservoir compartment;

the reservoir compartment is associated to the casing for receiving and housing the removable condensate reservoir, wherein the removable condensate reservoir can be extracted from and inserted into the reservoir compartment;

a supply line for cleaning a component of the dryer, the supply line being provided from a supply line inlet fluidly connected to the reservoir outlet when the removable condensate reservoir is inserted in the reservoir compartment, to a supply line outlet for delivering the condensed water to the component, a rinsing or flushing pump for conveying the condensed water from the supply line inlet to the supply line outlet;

a coupling arrangement associated to the reservoir outlet and/or the supply line inlet and adapted to actuate the closing element;

wherein the coupling arrangement is adapted to maintain the closing element in an open state when the removable condensate reservoir is inserted into the reservoir compartment, such that condensate liquid can freely flow from the reservoir outlet to the supply line; and wherein a portion of the supply line is located above a maximum condensate liquid level of the removable condensate reservoir.

2. Laundry dryer according to claim 1, wherein the reservoir compartment comprises or forms the supply line inlet.

3. Laundry dryer according to claim 1, wherein the reservoir compartment comprises a drain to convey condensed water back to a sump adapted to collect the condensed water formed at the heat exchanger, or wherein the reservoir compartment is not adapted to permanently or temporarily store liquid drained or spilled from the removable condensate reservoir.

4. Laundry dryer according to claim 1, wherein the coupling arrangement is associated to the reservoir compartment.

5. Laundry dryer according to claim 1, wherein the supply line comprises a siphon having a rising portion, a communication portion and a descending portion, and wherein the rinsing or flushing pump is arranged upstream or downstream the communication portion.

6. Laundry dryer according to claim 1, wherein the rinsing or flushing pump is arranged at an upper section of the dryer, or wherein the reservoir compartment comprises a supporting structure for the rinsing or flushing pump of the supply line.

7. Laundry dryer according to claim 5, wherein the rinsing or flushing pump or the siphon of the supply line is arranged at the backside of a rear wall or a rear frame of the casing, or wherein the rinsing or flushing pump is arranged outside the casing, or wherein the supply line extends at least partly at the backside of the rear wall of the casing.

8. Laundry dryer according to claim 5, wherein the communication portion of the supply line is arranged higher than a maximum liquid level of the removable condensate reservoir or is guided over the rinsing or flushing pump or over and adjacent to the removable condensate reservoir.

9. Laundry dryer according to claim 1, wherein the rinsing or flushing pump is arranged in a lower section of the dryer or at or on a cover shell in a base section of the dryer.

10. Laundry dryer according to claim 1, wherein the removable condensate reservoir comprises a first compartment for storing liquid and a second compartment for storing liquid, wherein the reservoir outlet is arranged at the first compartment.

11. Laundry dryer according to claim 10, wherein the first and second compartment are separated by a separation wall having a liquid passage arranged below the maximum liquid level of the first and/or second compartment, or wherein the first and second compartments are connected by the liquid passage arranged below the maximum liquid level of the first and/or second compartment.

12. Laundry dryer according to claim 11, wherein a ratio of maximum flow rates through the supply line to a maximum flow rate through the liquid passage is at least 2, 4, 6, 10 or 20, or wherein a cross section area of the liquid passage is less than 2, 1.5, 1, 0.5, 0.25 or 0.1 $cm^2$.

13. Laundry dryer according to claim 11, wherein a fluff filter is arranged at the liquid passage for filtering fluff from liquid passing the liquid passage between the first and/or second compartments.

14. Laundry dryer according to claim 1, wherein the supply line fluidly connects a stationary inlet of the supply line to an inlet of the rinsing or flushing pump.

15. Laundry dryer according to claim 5, wherein the rinsing or flushing pump is adapted to pump air from an emptied or nearly emptied removable condensate reservoir into the supply line, such that air can collect in the communication portion of the supply line and interrupt the flow of liquid by eliminating a siphon-effect.

16. Laundry dryer according to claim 5, wherein the supply line has an air inlet in the rising portion, descending portion or communication portion.

17. Laundry dryer according to claim 1, wherein a filter element is arranged at a condensate inlet of the removable condensate reservoir to filter fluff when liquid is supplied into the removable condensate reservoir, or wherein a filter element is arranged at the reservoir outlet for filtering fluff from the liquid exiting the removable condensate reservoir.

18. Laundry dryer according to claim 1, wherein the coupling arrangement comprises a filter element which is removably positioned in a liquid flow path, such when the removable condensate reservoir is inserted in the reservoir compartment the coupling arrangement opens the closing element and positions the filter element in the opened liquid flow path.

19. Laundry dryer according to claim 1, wherein one or more filter elements for filtering liquid are provided according to one or more of the following:

is arranged at an inlet of the removable condensate reservoir, is arranged at an outlet of the removable condensate reservoir, is arranged within the interior of the removable condensate reservoir, is positioned in the supply line, is arranged at or associated to the rinsing or flushing pump, is arranged in a rinsing or condensate liquid path at a base unit of the dryer, is arranged at or associated to the drain pump, is positioned in the drain line fluidly connecting the outlet of the drain pump to the removable condensate reservoir, and is integrated with, arranged at or associated to the component.

20. Laundry dryer according to claim 5, wherein one or more filter elements for filtering liquid is positioned between the siphon and an outlet or nozzle for draining or spraying rinsing liquid to the component.

* * * * *